US007938396B2

(12) United States Patent
Okumura et al.

(10) Patent No.: US 7,938,396 B2
(45) Date of Patent: May 10, 2011

(54) SHEET FEEDING DEVICE AND IMAGE FORMING APPARATUS INCLUDING SHEET FEEDING DEVICE WITH A SHEET FEEDING PREPARATION PERIOD

(75) Inventors: Keiji Okumura, Osaka (JP); Yoshio Sugishima, Osaka (JP); Yoshihiro Yamaguchi, Osaka (JP)

(73) Assignee: Kyocera Mita Corporation (JP)

( * ) Notice: Subject to any disclaimer, the term of this patent is extended or adjusted under 35 U.S.C. 154(b) by 33 days.

(21) Appl. No.: 12/536,755

(22) Filed: Aug. 6, 2009

(65) Prior Publication Data

US 2010/0032890 A1 Feb. 11, 2010

(30) Foreign Application Priority Data

Aug. 8, 2008 (JP) ..... 2008-206024
Sep. 22, 2008 (JP) ..... 2008-242030

(51) Int. Cl.
*B65H 1/08* (2006.01)

(52) U.S. Cl. ..... 271/127; 271/97; 271/128; 271/130; 271/153; 271/154

(58) Field of Classification Search ..... 271/127, 271/128, 130, 153–154, 97
See application file for complete search history.

(56) References Cited

U.S. PATENT DOCUMENTS

| | | | | |
|---|---|---|---|---|
| 4,925,177 | A * | 5/1990 | Nakamura et al. | 271/127 |
| 6,186,492 | B1 * | 2/2001 | Dechau et al. | 271/98 |
| 6,609,708 | B2 * | 8/2003 | Moore et al. | 271/98 |
| 7,451,973 | B2 | 11/2008 | Koga et al. | |
| 7,841,591 | B2 * | 11/2010 | Ueda et al. | 271/98 |
| 2007/0080491 | A1 * | 4/2007 | Suga et al. | 271/97 |
| 2008/0088077 | A1 * | 4/2008 | Fujita | 271/90 |

FOREIGN PATENT DOCUMENTS

| | | | |
|---|---|---|---|
| JP | 7-12359 | | 3/1995 |
| JP | 2001-48366 | | 2/2001 |
| JP | 2003-150024 | | 5/2003 |
| JP | 2005104723 | A * | 4/2005 |
| JP | 2006-264917 | | 10/2006 |

* cited by examiner

*Primary Examiner* — Gerald W McClain
(74) *Attorney, Agent, or Firm* — Gerald E. Hespos; Michael J. Porci

(57) ABSTRACT

A sheet feeding device has a sheet accommodating portion for accommodating a sheet stack, a sheet carrying plate for carrying the sheet stack and a pickup roller that dispatches the uppermost sheet of the stack. An elevator displaces the sheet carrying plate between a sheet feeding position where an upper face of the sheet stack contacts the pickup roller and a separating position where the upper face of the sheet stack is separated from the pickup roller. A first warm air mechanism blows warm air toward a side face of the sheet stack. A controller causes the first warm air mechanism to blow warm air to the side face of the sheet stack and causes the elevator to displace the sheet carrying plate between the sheet feeding position and the separating position.

17 Claims, 22 Drawing Sheets

SHEET FEEDING DEVICE AND IMAGE FORMING APPARATUS INCLUDING SHEET FEEDING DEVICE WITH A SHEET FEEDING PREPARATION PERIOD

This application claims priority under 35 USC 119 to Japanese Patent Application Serial No. 2008-206024 filed on Aug. 8, 2008 and Japanese Patent application Serial No. 2008-242030 filed on Sep. 22, 2008, the contents of which are incorporated herein by reference.

BACKGROUND OF THE INVENTION

1. Field of the Invention

The present invention relates to a sheet feeding device having a sheet loosening mechanism that employs warm air assistance, and an image forming apparatus including the sheet feeding device.

2. Description of the Related Art

In a conventional image forming apparatus such as a printer, a copier, or a facsimile, cut sheets of high quality paper, regular paper specified by a copier manufacturer, and so on are typically used as a sheet fed continuously into an image formation unit. A cut sheet of high quality paper, regular paper, and so on has low surface smoothness, and therefore a sheet sticking force thereof is comparatively low. It is therefore comparatively easy to prevent multi-feeding, in which a plurality of cut sheets are supplied while stuck together, when dispatching the cut sheets one at a time from a sheet carrying unit such as a sheet feeding tray. Furthermore, even when multi-feeding occurs during use of the cut sheets, the cut sheets can be dispatched one at a time comparatively favorably by providing a separating roller, a separating pad, a separating pawl, or similar.

In recent years, however, diversification of sheet has progressed to the point where not only sheets of high quality paper, regular paper, and so on having low surface smoothness are used. In particular, as colorization techniques become more advanced in image forming apparatuses, the use of recording media having high surface smoothness, such as enhanced-whiteness gloss enamel paper (composite paper coated on one or both sides with a coating color, which is a type of paint, with the aim of improving printing suitability), is becoming more widespread. In other words, not only high quality paper and regular paper, but also the enamel paper described above as well as film sheets, tracing paper, and so on are used in the same machine type. Enamel paper, film sheet, tracing paper, and so on exhibits a strong inter-sheet sticking force, and it is therefore difficult to prevent multi-feeding of the sheets. Hence, special measures must be taken in relation to sheet feeding (sheet dispatch).

Furthermore, an upper face and a peripheral part of a stack of sheets disposed on the sheet carrying unit are exposed to outside air, and are therefore likely to contain a large amount of moisture. In other words, the upper face and side faces of the sheet stack swell due to moisture absorption, whereas the degree of swelling on the inside of the sheet stack is lower than that of the upper face and side faces due to the smaller amount of moisture. As a result, pressure inside (in the inter-sheet spaces of) the sheet stack may turn negative such that the sheets stick together.

To loosen the sheet stack by separating sheets that are stuck together prior to sheet feeding, large copiers and so on employ a sheet feeding device having a mechanism (to be referred to hereafter as "lateral warm air assistance") for blowing warm air onto the side face of the sheet stack.

For example, Japanese Unexamined Patent Application No. 2001-48366 discloses a technique for improving sheet drying efficiency in a sheet loosening method employing lateral warm air assistance by appropriately adjusting the humidity of lateral warm air that is blown onto the side face of a sheet stack.

However, in the conventional sheet loosening technique employing lateral warm air assistance described above, it is difficult for the warm air to reach regions remote from a warm air blowing port, and it is therefore difficult to loosen the sheets by introducing warm air into the vicinity of the outer periphery of the sheets, in which the sticking force is particularly strong. In other words, when lateral warm air assistance is used conventionally, required warm air blowing means, heating means, a power supply, and so on must all be large to obtain a favorable loosening effect. Therefore, conventional sheet loosening techniques employing lateral warm air assistance are limited to application to comparatively large sheet feeding decks accommodating between approximately 2000 and 4000 sheets.

SUMMARY OF THE INVENTION

An object of the present invention is to provide a sheet feeding device that can be disposed in a small space and includes a sheet loosening mechanism employing warm air assistance, and an image forming apparatus having the sheet feeding device.

A sheet feeding device according to one aspect of the present invention for achieving this object is a sheet feeding device for feeding a sheet, including a sheet accommodating portion for accommodating a sheet stack constituted by a plurality of sheets, a sheet carrying plate provided in the sheet accommodating portion and carrying the sheet stack, a pickup roller that contacts an upper face of the sheet stack and dispatches the sheet of an uppermost layer of the sheet stack, an elevator mechanism that displaces the sheet carrying plate between a sheet feeding position in which the upper face of the sheet stack contacts the pickup roller and a separating position in which the upper face of the sheet stack is separated from the pickup roller, a first warm air mechanism for blowing warm air toward a side face of the sheet stack accommodated in the sheet accommodating portion, the side face being parallel to the sheet feeding direction, and a controller for controlling the operation of the elevator mechanism and the operation of the first warm air mechanism during a sheet feeding preparation period before starting a sheet feeding operation for feeding a first sheet of the sheet stack, wherein the controller performs control for operating the first warm air mechanism to blow warm air to the side face of the sheet stack and operating the elevator mechanism to cause the elevator mechanism to carry out, at least once, a separating operation for displacing the sheet carrying plate between the sheet feeding position and the separating position.

Further, an image forming apparatus according to another aspect of the present invention includes a sheet feeding device for feeding a sheet, and an apparatus main body including an image formation unit for forming an image on the sheet fed from the sheet feeding device, wherein the sheet feeding device is constituted as described above.

DETAILED DESCRIPTION OF THE PREFERRED EMBODIMENTS

Several embodiments of the present invention will be described in detail below on the basis of the drawings. It is assumed that in each of the drawings, members and so on having identical reference symbols are constituted identically, and therefore duplicate description of these members and so on has been omitted where appropriate. Furthermore, members and so on that do not need to be described have been omitted from the drawings where appropriate.

First Embodiment

Figure 1:
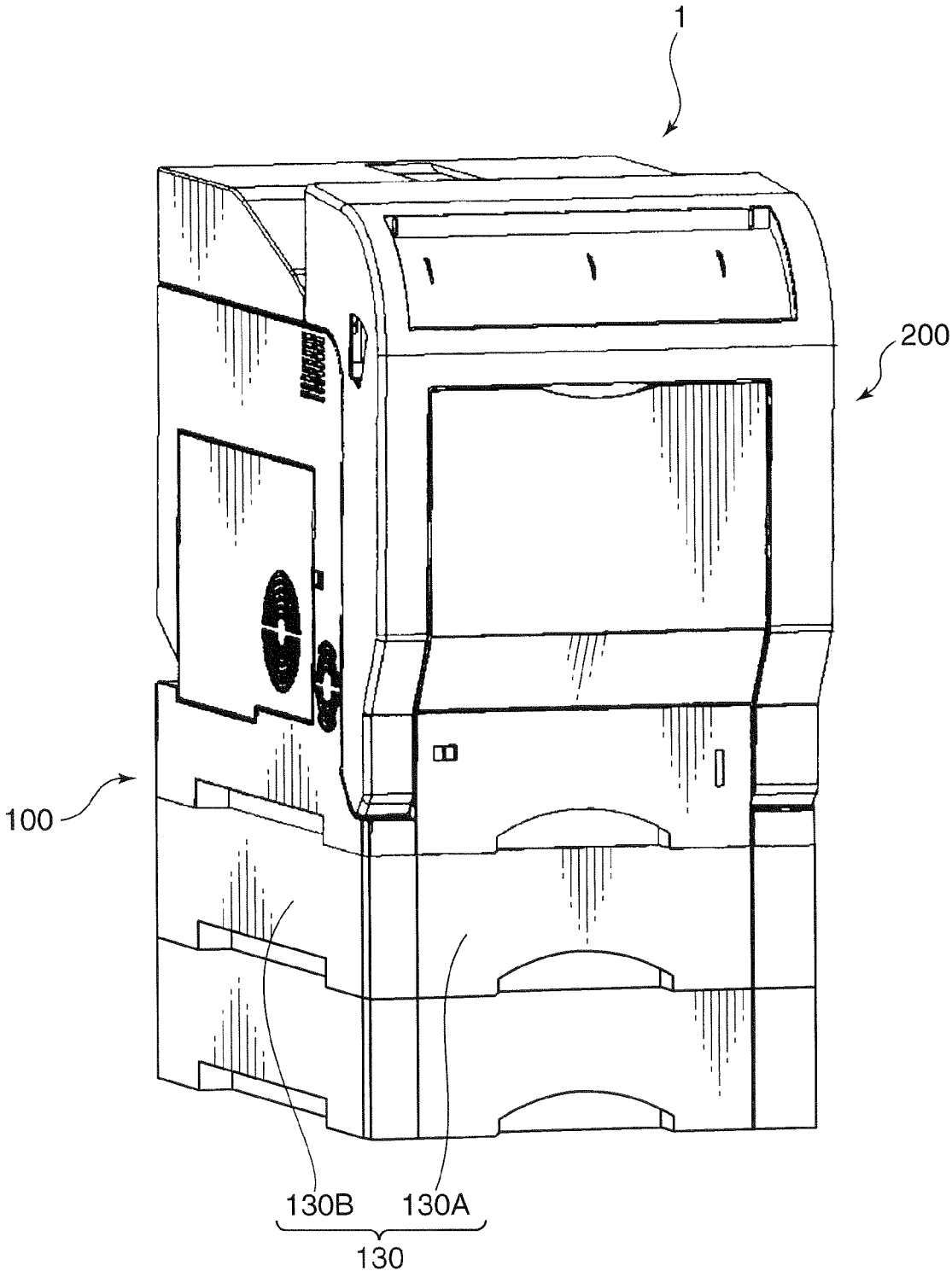
FIG. 1 is a perspective view showing the outer form of a printer including a sheet feeding device according to an embodiment of the present invention.

First, referring to FIGS. 1 and 2, an image forming apparatus including a sheet feeding device according to an embodiment of the present invention will be described. FIG. 1 is a perspective view showing the outer form of an image forming apparatus (a color printer 1) including a sheet feeding device (a sheet feeding unit 130) according to a first embodiment, and FIG. 2 is a sectional view showing the internal structure of the image forming apparatus.

As shown in FIG. 1, the color printer 1 includes a printer main body 200 connected to a personal computer (PC) (not shown) or the like directly or via a LAN, and a sheet supply unit 100 provided beneath the printer main body 200 and constituted to be capable of storing sheets P of various sizes in accordance with their size. Note that the color printer 1 also includes other constitutional elements typically provided in a color printer, such as a control circuit for controlling operations of the color printer 1.

Figure 2:
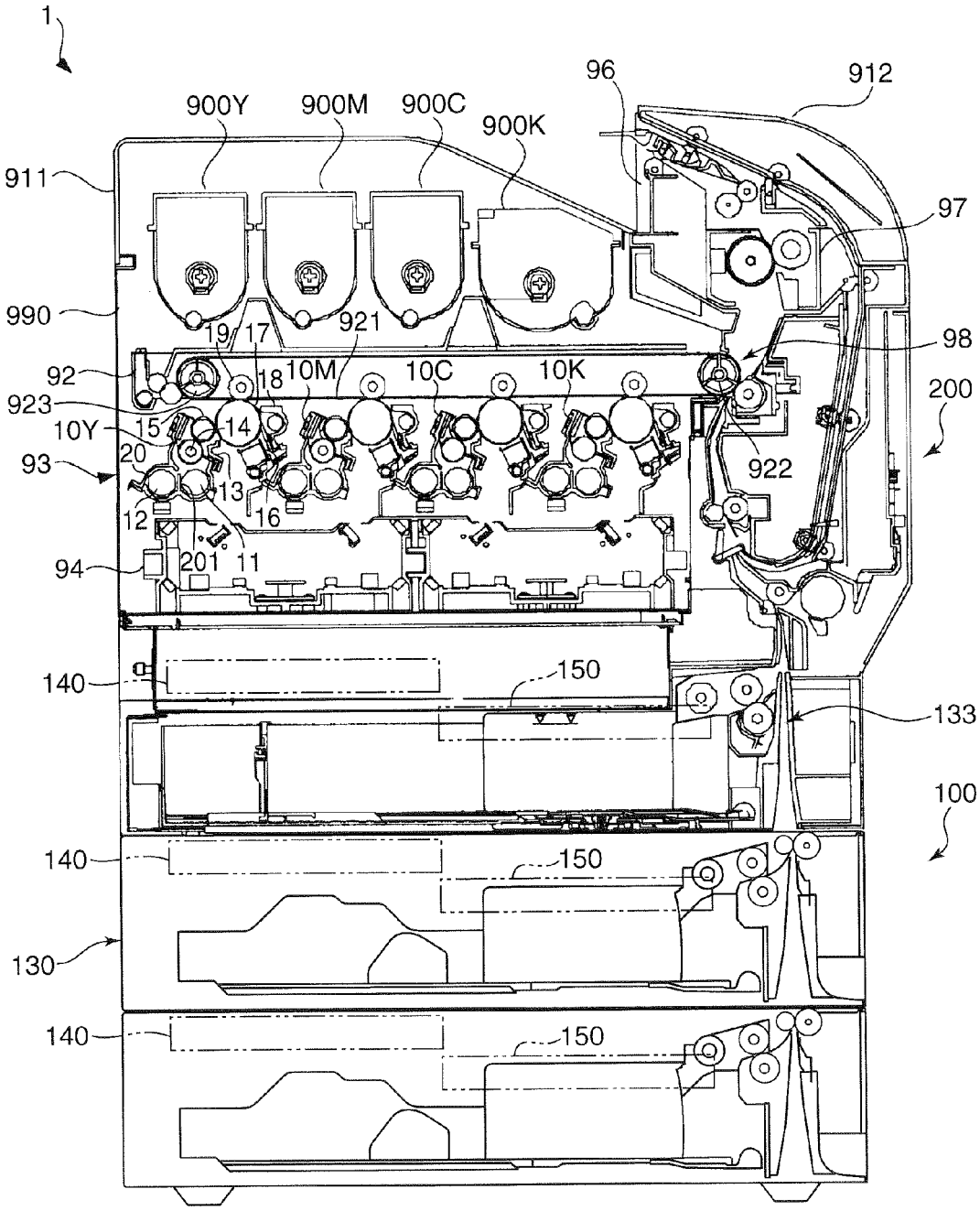
FIG. 2 is a sectional view showing the internal constitution of the printer shown in FIG. 1.

As shown in FIG. 2, the printer main body 200 includes toner containers 900Y, 900M, 900C, 900K, an intermediate transfer unit 92, an image formation unit 93, an exposure unit 94, the sheet supply unit 100, a fixing unit 97, a sheet discharge unit 96, an apparatus main body casing 990, a top cover 911, and a front cover 912.

The image formation unit 93 includes a yellow toner container 900Y, a magenta toner container 900M, a cyan toner container 900C, a black toner container 900K, and developing devices 10Y, 10M, 10C, 10K disposed therebelow in accordance with the respective colors YMCK.

Further, photosensitive drums 17 (photosensitive bodies on which latent images are formed by an electrophotographic method) for carrying toner images in the respective colors are provided in the image formation unit 93. A photosensitive drum using an amorphous silicon (a-Si)-based material may be employed as the photosensitive drum 17. Yellow, magenta, cyan, and black toner is supplied to the respective photosensitive drums 17 from the corresponding toner container 900Y, 900M, 900C, 900K. The image formation unit 93 described above is capable of forming a full color image, but the image formation unit is not limited thereto, and may be constituted to form monochrome images or color images that are not full color.

A charger 16, the developing devices 10 (10Y, 10M, 10C, 10K), a transfer device (transfer roller) 19, a cleaning device 18, and so on are disposed around the photosensitive drum 17. The charger 16 charges the surface of the photosensitive drum 17 uniformly. After being charged, the surface of the photosensitive drum 17 is exposed by the exposure unit 94 such that an electrostatic latent image is formed thereon. The developing devices 10Y, 10M, 10C, 10K use the colored toner supplied by the respective toner containers 900Y, 900M, 900C, 900K to develop (make visible) the electrostatic latent images formed on the respective photosensitive drums 17. The transfer roller 19 forms a nip portion by pressing the intermediate transfer belt 921 against the photosensitive drum 17 and thereby subjects the toner image formed on the photosensitive drum 17 to primary transfer onto the intermediate transfer belt 921. The cleaning device 18 cleans the peripheral surface of the photosensitive drum 17 following toner image transfer.

Each developing devices 10Y, 10M, 10C, 10K includes the casing 20, and a two-component developer constituted by a magnetic carrier and a toner is stored in the interior of the casing 20. Further, two agitating rollers 11, 12 (developer agitating members) are disposed rotatably in the vicinity of a bottom portion of the casing 20 in parallel, taking a lengthwise direction as their axial direction.

A developer circulation route is set on the interior bottom surface of the casing 20, and the agitating rollers 11, 12 are disposed on the circulation route. A partition wall 201 standing upright from the casing bottom portion is provided in the axial direction between the agitating rollers 11, 12. The partition wall 201 defines the circulation route, and the circulation route is formed to travel around the periphery of the partition wall 201. The two-component developer is charged while being agitated by the agitating rollers 11 and 12 so as to travel along the circulation route.

The two-component developer circulates through the casing 20 while being agitated by the agitating rollers 11 and 12, whereby the toner is charged and the two-component developer on the agitating roller 11 is aspirated onto and conveyed by a magnetic roller 14 positioned on an upper side thereof. The aspirated two-component developer forms a magnetic brush (not shown) on the magnetic roller 14. A layer thickness of the magnetic brush is limited by a doctor blade 13. A toner layer is formed on a developing roller 15 by a potential difference between the magnetic roller 14 and the developing roller 15, and the electrostatic latent image on the photosensitive drum 17 is developed by the toner layer.

The exposure unit 94 includes various optical devices such as a light source, a polygon mirror, a reflection mirror, and a deflection mirror, and irradiates the peripheral surface of the photosensitive drum 17 provided in each of the image formation units 93 with light based on image data to form the electrostatic latent image.

The intermediate transfer unit 92 includes the intermediate transfer belt 921, a drive roller 922, and a driven roller 923. The intermediate transfer belt 921 performs a primary transfer on superimposed toner images applied thereto from the plurality of photosensitive drums 17, and then subjects the toner image to a secondary transfer onto a sheet P supplied by the sheet feeding unit 130 at a secondary transfer portion 98. The drive roller 922 and driven roller 923 drive the intermediate transfer belt 921 to revolve. The drive roller 922 and driven roller 923 are supported by a casing, not shown in the drawings, to be free to rotate.

The fixing unit 97 implements fixing processing on the toner image subjected to the secondary transfer onto the sheet P from the intermediate transfer unit 92. Following completion of the fixing processing, the sheet P with a color image is discharged toward the discharge unit 96 formed on an upper portion of the apparatus main body 200.

The sheet discharge unit 96 discharges the sheet P conveyed thereto from the fixing unit 97 onto the top cover 911, which serves as a sheet discharge tray.

The sheet supply unit 100 includes a plurality of (three in this embodiment) sheet feeding units 130 (sheet feeding devices) attached detachably to the printer main body 200 in tiers. Each sheet feeding unit 130 accommodates a sheet stack S constituted by a plurality of sheets P to be subjected to image formation, and is attached detachably to the casing 990. Sheet stacks S in each of the aforementioned sizes are stored in the respective sheet feeding units 130. In a selected sheet feeding unit 130 during an image formation operation, sheets P on the uppermost layer of the sheet stack S are extracted one at a time by driving a pickup roller 40 provided in the sheet feeding unit 130, dispatched onto a sheet feeding conveyance path 133, and introduced into the image formation unit 93.

Each sheet feeding unit 130 includes a conveyance mechanism, a plurality of which can be attached to a lower portion of the printer main body 200 subsequently in a stacked plurality, and thus, a desired number of the sheet feeding units 130 can be attached subsequently to the printer main body 200 at any time. In other words, by stacking a plurality of the sheet feeding units 130 in the lower portion of the printer main body 200, the conveyance mechanisms provided in the respective sheet feeding units 130 are coupled to each other to form the single sheet feeding conveyance path 133 extending to the printer main body 200. Hence, the sheet feeding units 130 can be attached subsequently in a plurality of stacked tiers.

Note that in this embodiment, an example in which the sheet supply unit 100 is constituted by three sheet feeding units 130 is described, but the present invention is not limited thereto, and may be applied similarly to an image forming apparatus such as a printer having one, two, four, or more sheet feeding units 130.

Next, with reference to FIG. 1 and FIGS. 3 to 5, the constitution of each sheet feeding unit 130 attached to the sheet supply unit 100 of the color printer 1 according to the first embodiment will be described in detail. As shown in FIG. 1, the sheet feeding unit 130 is constituted by a sheet feeding cassette 130A and a sheet feeding unit main body 130B. The sheet feeding cassette 130A slides forward and backward relative to the sheet feeding unit main body 130B. A typical sliding mechanism (a drawer mechanism) may be employed in the sheet feeding cassette 130A and the sheet feeding unit main body 130B.

Figure 3:
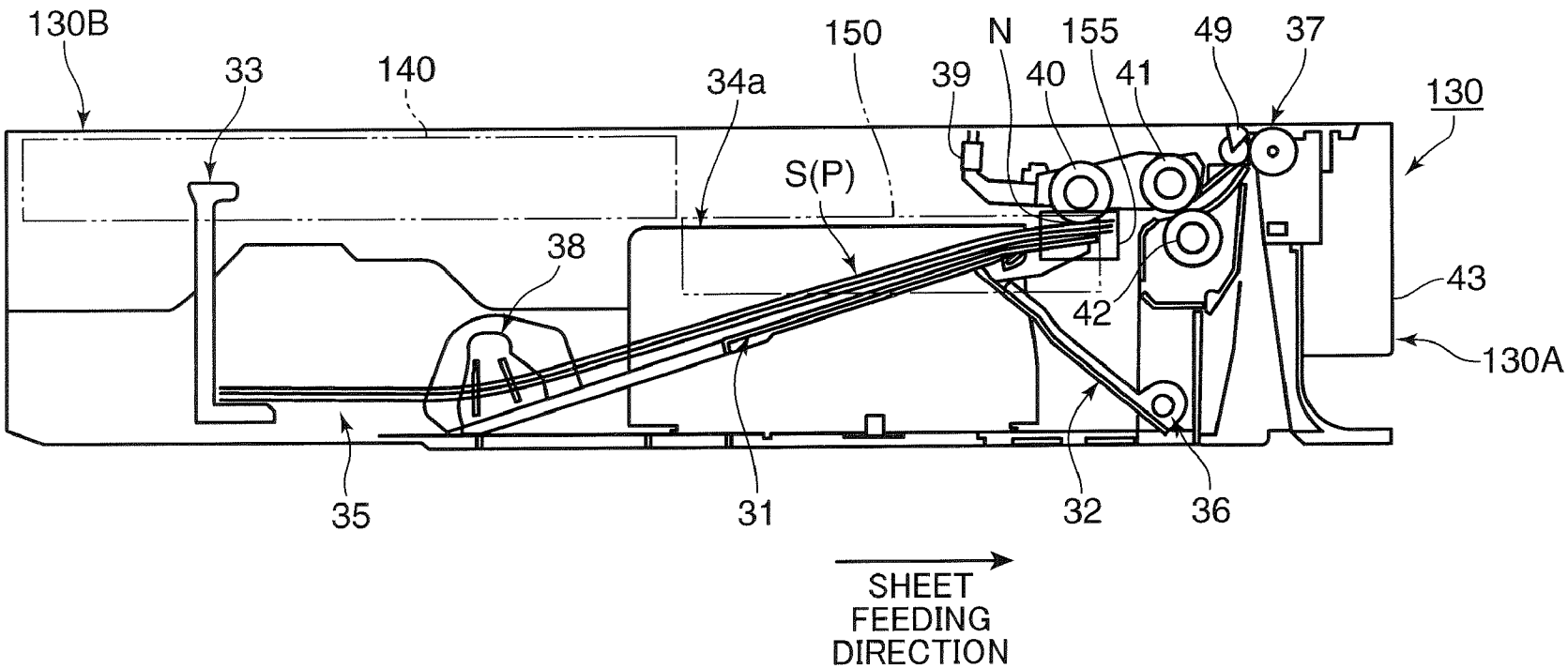
FIG. 3 is a sectional view showing the constitution of a sheet feeding device according to a first embodiment of the present invention.
Figure 4:
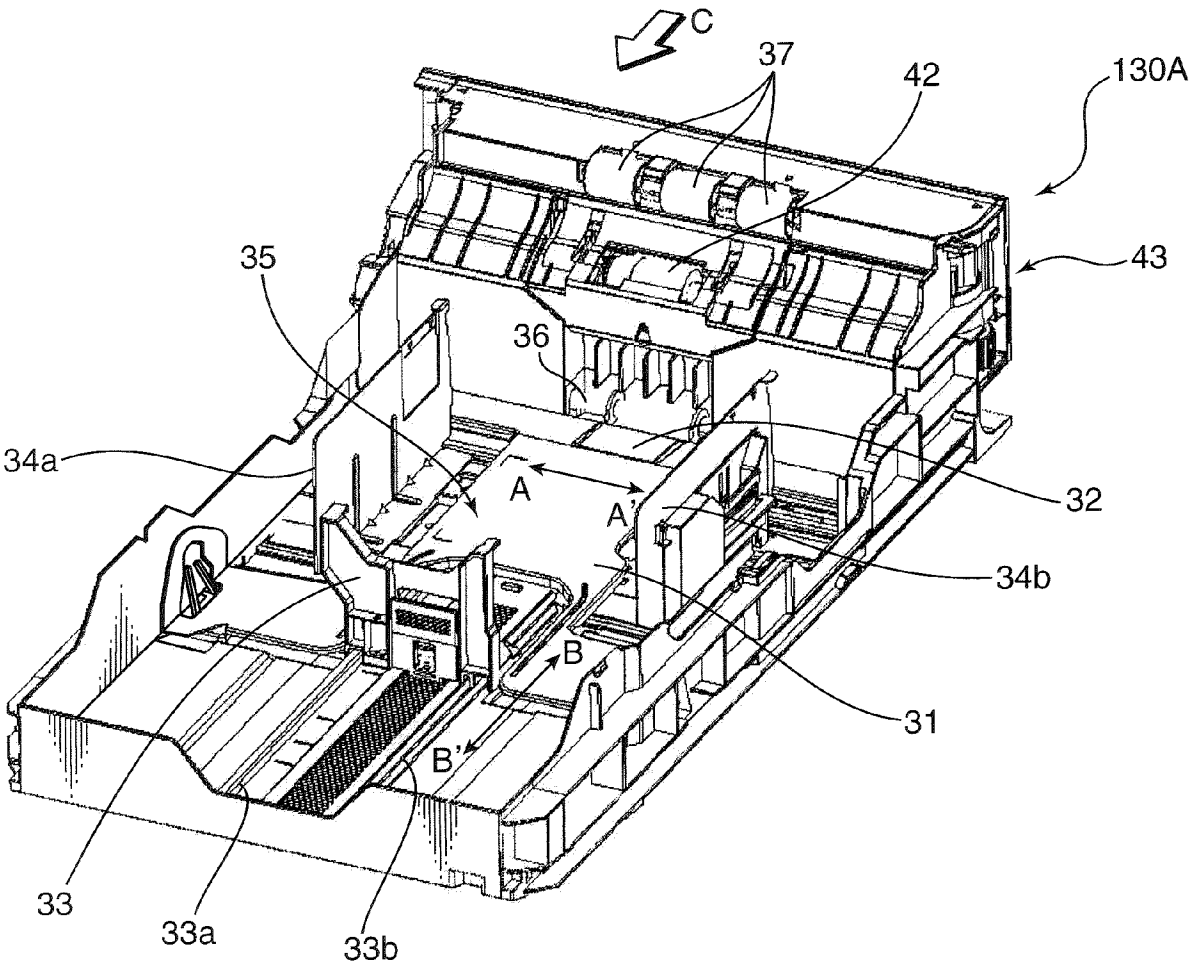
FIG. 4 is a perspective view showing a state in which a sheet feeding cassette of the sheet feeding device shown in FIG. 3 is withdrawn from a sheet feeding device main body.
Figure 5B:
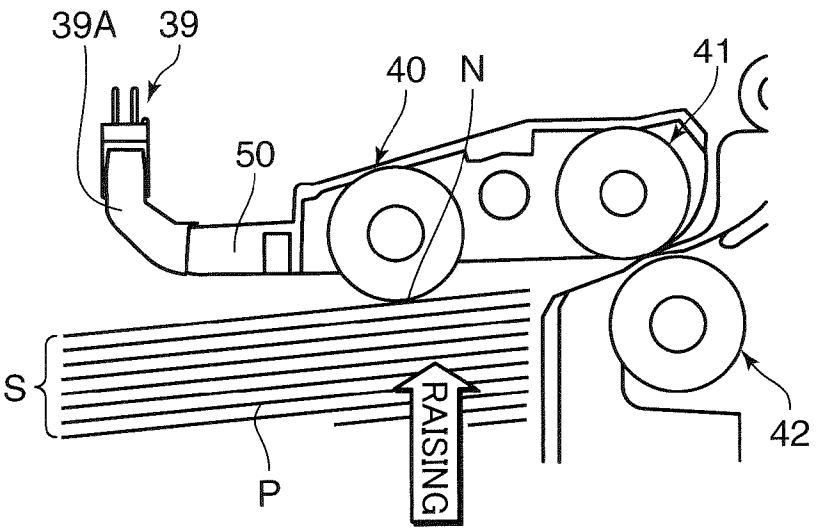
FIGS. 5A and 5B are illustrative views showing a position detection sensor installed in the sheet feeding device.
Figure 5A:
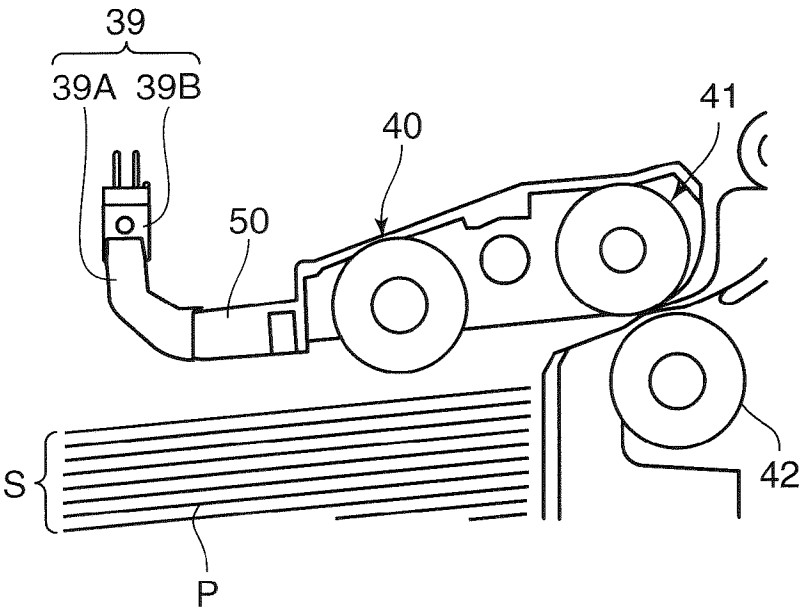

FIG. 3 is a sectional view showing the constitution of the sheet feeding unit 130 (sheet feeding device) according to the first embodiment. FIG. 4 is a perspective view showing a state in which the sheet feeding cassette 130A of the sheet feeding unit 130 is withdrawn from the sheet feeding unit main body 130B. FIGS. 5A and 5B are illustrative views showing a position detection sensor 39 installed in the sheet feeding unit 130.

As shown in FIGS. 3 and 4, a lift plate 31 (sheet carrying plate) for carrying the sheet stack S constituted by a plurality of the sheets P is provided on the interior bottom surface of a sheet accommodating portion 35 of the sheet feeding unit 130. A sheet feeding direction upstream side end (a left side end portion in FIG. 3) of the lift plate 31 is supported rotatably by a support portion 38. In other words, the lift plate 31 can be rotated by the support portion 38 in a vertical plane in the interior of the sheet accommodating portion 35 using a downstream end thereof as a free end. The support portion 38 is provided on wall portions on either side of the sheet accommodating portion 35, which is disposed to face a width direction of the sheet P (an orthogonal direction to the sheet feeding direction).

The sheet feeding cassette 130A of the sheet feeding unit 130 includes a pair of width alignment cursors 34*a*, 34*b* for positioning the sheets P accommodated in the sheet accommodating portion 35 in the width direction, and a rear end cursor 33 for aligning a rear end of the sheets P. The pair of width alignment cursors 34*a*, 34*b* are provided to be capable of performing a reciprocating motion in the sheet width direction (a direction indicated by an arrow AA' in FIG. 4) along respective guide rails, not shown in the drawings. Here, the sheet P is dispatched in a direction indicated by an arrow B in FIG. 4, and therefore the rear end cursor 33 is provided to be capable of performing a reciprocating motion parallel to the sheet conveyance direction (a direction indicated by an arrow BB' in FIG. 4) along guide rails 33*a*, 33*b*. The sheet stack S is accommodated in a predetermined position of the sheet feeding unit 130 once the width alignment cursors 34*a*, 34*b* and the rear end cursor 33 have been moved in accordance with the size of the carried sheets. The sheet feeding unit 130 includes a cassette cover 43, a front surface side (a side seen from a direction indicated by an arrow C in FIG. 4) of which is exposed to the outside to form a part of an outer covering surface of the color printer 1.

Figure 13:
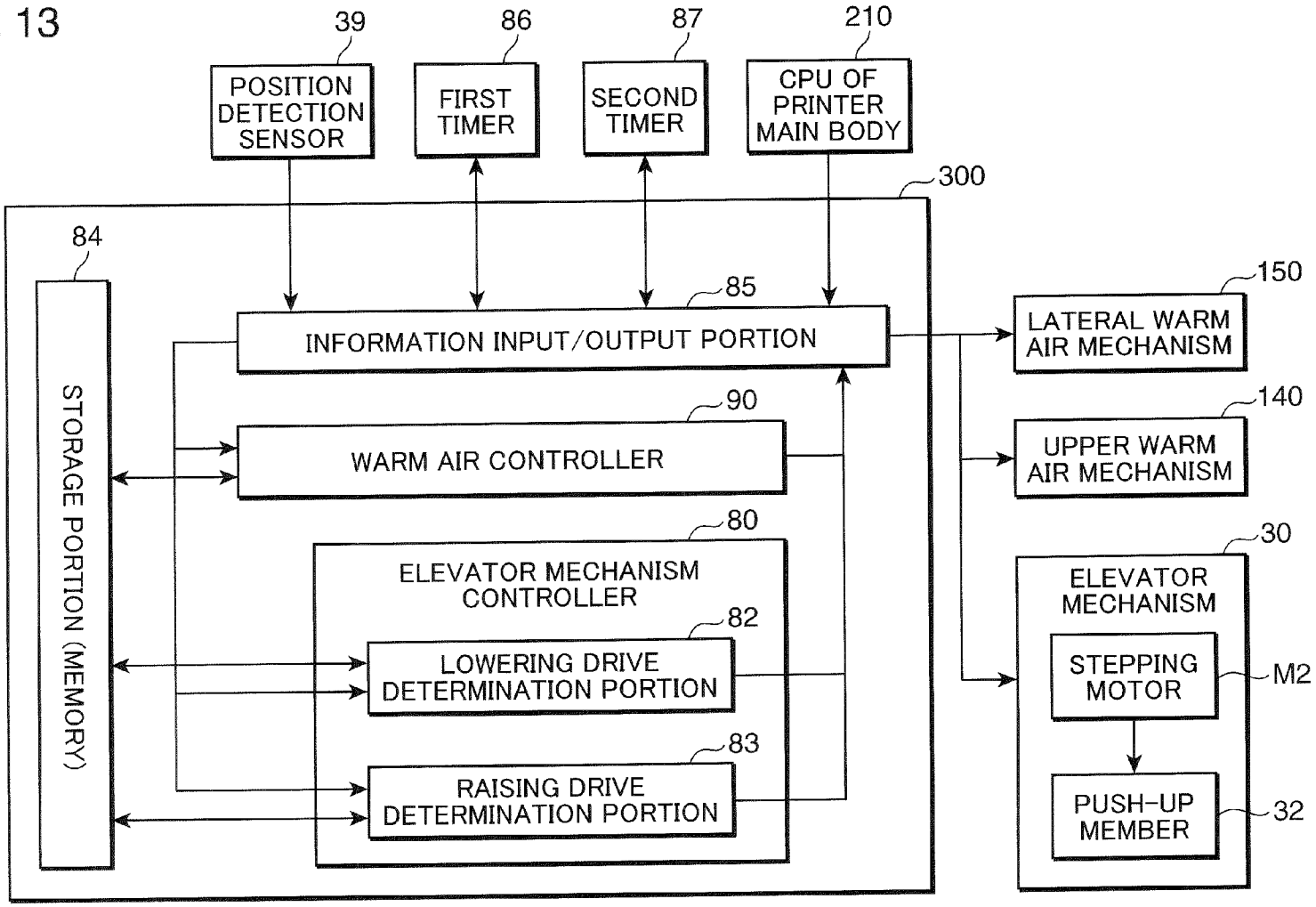
FIG. 13 is a function block diagram of a controller controlling a warm air blowing operation in the sheet feeding device according to the first embodiment.
Figure 15:
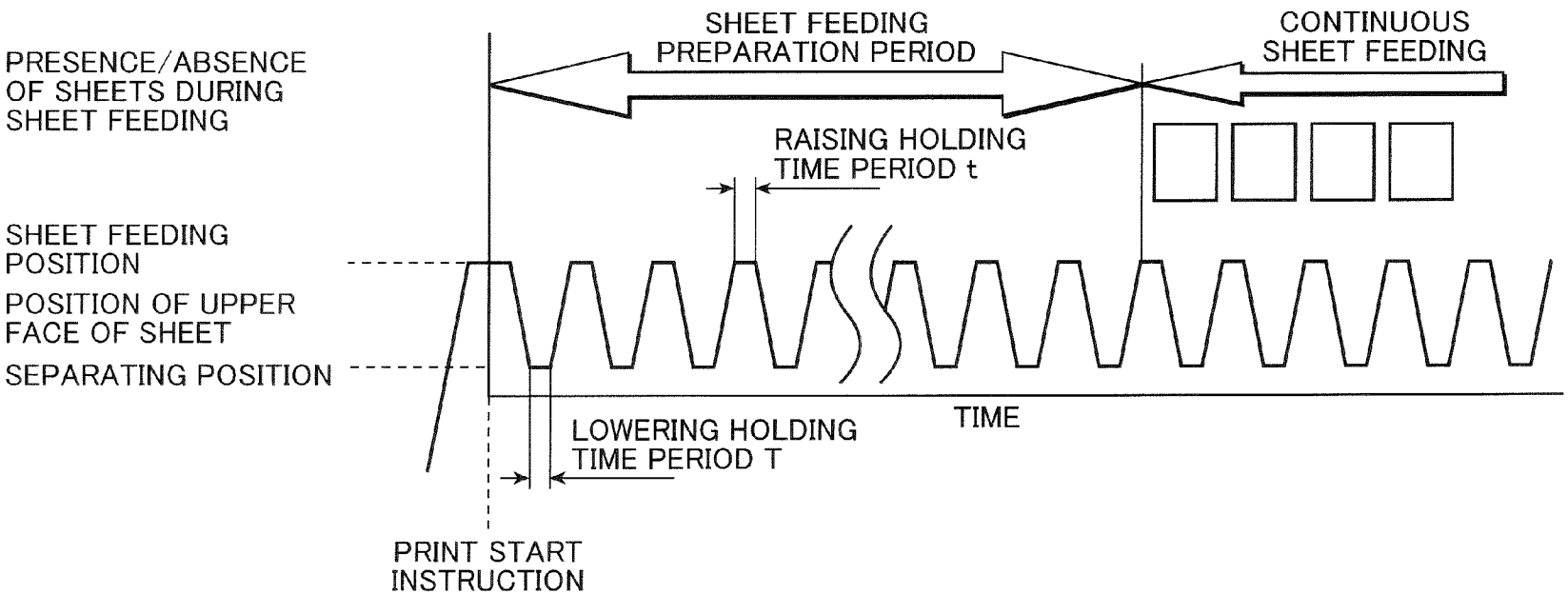
FIG. 15 is a time chart illustrating the control operation shown in FIG. 14.

A drive shaft 36, a push-up member 32, and a driving connecting member (not shown) are provided below a sheet feeding direction downstream portion of the lift plate 31 as the constituents of an elevator mechanism 30 for raising and lowering the lift plate 31 (FIGS. 13 and 15). Further, a receiving member (not shown) corresponding to the driving connecting member and a motor (not shown) that is connected to the receiving member and capable of normal and reverse rotation are provided on the sheet feeding unit main body 130B side. When the sheet feeding cassette 130A is accommodated in the sheet feeding unit main body 130B, the driving connecting member of the sheet accommodating portion 35 on the sheet feeding cassette 130A side engages connectedly with the receiving member on the sheet feeding unit main body 130B side. Thus, the power of the motor can be transmitted to the drive shaft 36. The elevator mechanism, which displaces the lift plate 31 between a sheet feeding position and a separated position separated from the sheet feeding position, is constituted by the drive shaft 36, the push-up member 32, the driving connecting member, the receiving member, and the motor. In the sheet feeding position, the lift plate 31 is raised such that an upper face of the sheet stack S carried on the lift plate 31 contacts the pickup roller 40, enabling sheet feeding. In the separated position, the lift plate 31 is lowered to a lower limit.

Note that a stepping motor M2, a DC motor or the like shown in FIG. 13, for example, can be used as the motor constituting the elevating mechanism 30 for raising and lowering the lift plate 31.

Further, as shown in FIG. 3, the sheet feeding unit 130 includes a sheet feeding roller 41 provided on a conveyance direction downstream side of the pickup roller 40, and a loosening roller 42 provided below the sheet feeding roller 41. Further, a conveyance roller 37 is provided on the conveyance direction downstream side of the pickup roller 40 and the sheet feeding roller 41. The sheet feeding roller 41 is provided on the sheet feeding unit main body 130B side together with the pickup roller 40, whereas the loosening roller 42 and the conveyance roller 37 are provided on the sheet feeding cassette 130A side. When the sheet feeding cassette 130A is attached to the sheet feeding unit main body 130B, the sheet feeding roller 41 contacts the loosening roller 42.

The sheet feeding roller 41 feeds a sheet P extracted from the sheet stack S by the pickup roller 40 to the conveyance roller 37. The sheet feeding roller 41 rotates in a direction for conveying the sheet P downstream, whereas the loosening roller 42 rotates in an opposite direction for returning the sheet P upstream. In a case where a plurality of overlapped sheets P is extracted by the pickup roller 40, the loosening roller 42 can be used to prevent all but the uppermost sheet P from being fed in the direction of the conveyance roller 37, and thus only the uppermost sheet P is conveyed to the conveyance roller 37 by the sheet feeding roller 41. The conveyance roller 37 conveys the sheet P onto the sheet feeding conveyance path 133 (see FIG. 2).

Further, as shown in FIGS. 5A and 5B, the sheet feeding unit 130 includes the position detection sensor 39 for detecting that the uppermost sheet P of the sheet stack S carried on the lift plate 31 is in the sheet feeding position. The position detection sensor 39 is constituted by a light blocking member 39A and an optical sensor 39B. The optical sensor 39B is constituted by a light emitting element provided fixedly in the vicinity of the pickup roller 40, and a light receiving element for receiving light emitted by the light emitting element. The light blocking member 39A is provided on a support member 50 of the pickup roller 40. Further, the support member 50 is provided to be capable of rotating about a rotary axis of the sheet feeding roller 41.

Hence, when the lift plate 31 is raised such that the upper face of the sheet stack S carried on the lift plate 31 moves into the sheet feeding position shown in FIG. 5B, the pickup roller 40 is pushed up by the uppermost sheet P so as to rotate about the rotary axis of the sheet feeding roller 41 and thereby displace slightly upward. At this time, the light blocking member 39A is lifted up in conjunction with the pickup roller 40, thereby blocking an optical path of the optical sensor 39B, and accordingly, it is possible to detect that the upper face of the sheet stack S is in the sheet feeding position.

When the motor is activated in the sheet feeding unit 130 constituted as described above, the push-up member 32 pushes up the downstream end side of the lift plate 31 while remaining engaged with the bottom surface of the lift plate 31. As a result, the upper face of the sheet stack S carried on the lift plate 31 displaces to the sheet feeding position contacting the pickup roller 40 provided above the sheet feeding cassette 130A.

At this time, driving of the motor is stopped when the position detection sensor 39 detects displacement of the pickup roller 40 to the sheet feeding position, as shown in FIG. 5B. Further, when the position detection sensor 39 no longer detects this displacement due to a reduction in the number of sheets P during sheet feeding, the motor is activated to lift the sheet stack S up to the sheet feeding position.

Note that in this embodiment, a detected portion (the light blocking member 39A) is provided on the support member 50 of the pickup roller 40, but the present invention is not limited thereto, and the upper face of the sheet stack S may be detected directly in the vicinity of the pickup roller 40 or using a detection mechanism other than an optical sensor, for example.

The sheet feeding unit 130 according to this embodiment has a lateral warm air mechanism (first warm air mechanism) 150 as a sheet loosening mechanism employing warm air, as shown in FIGS. 3 and 6 to 9. The lateral warm air mechanism 150 blows warm air onto a side face of the sheet stack S accommodated in the sheet feeding cassette 130A, the side face being parallel to the sheet feeding direction.

Figure 6:
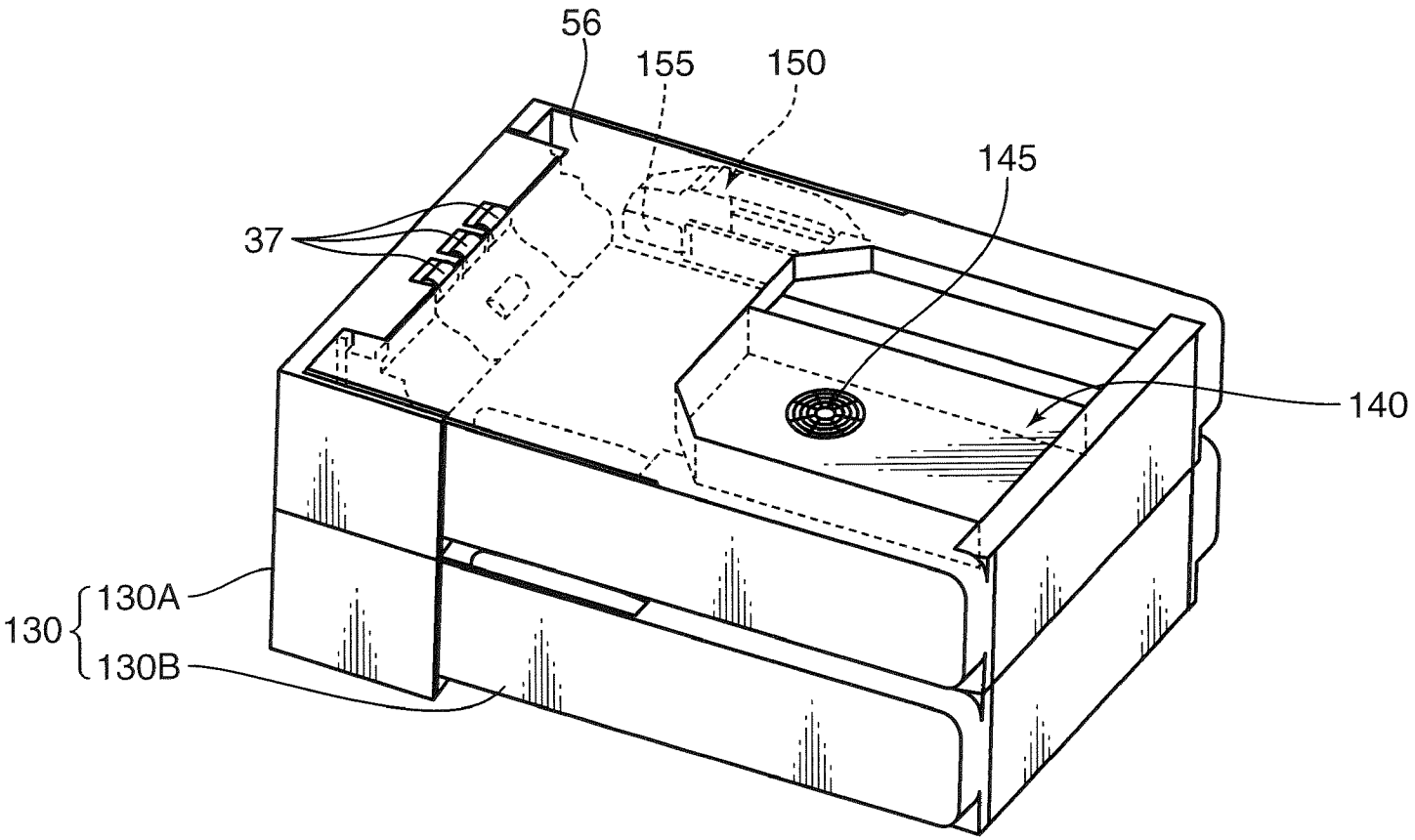
FIG. 6 is a perspective view illustrating the constitution of the sheet feeding device according to the first embodiment.
Figure 7:
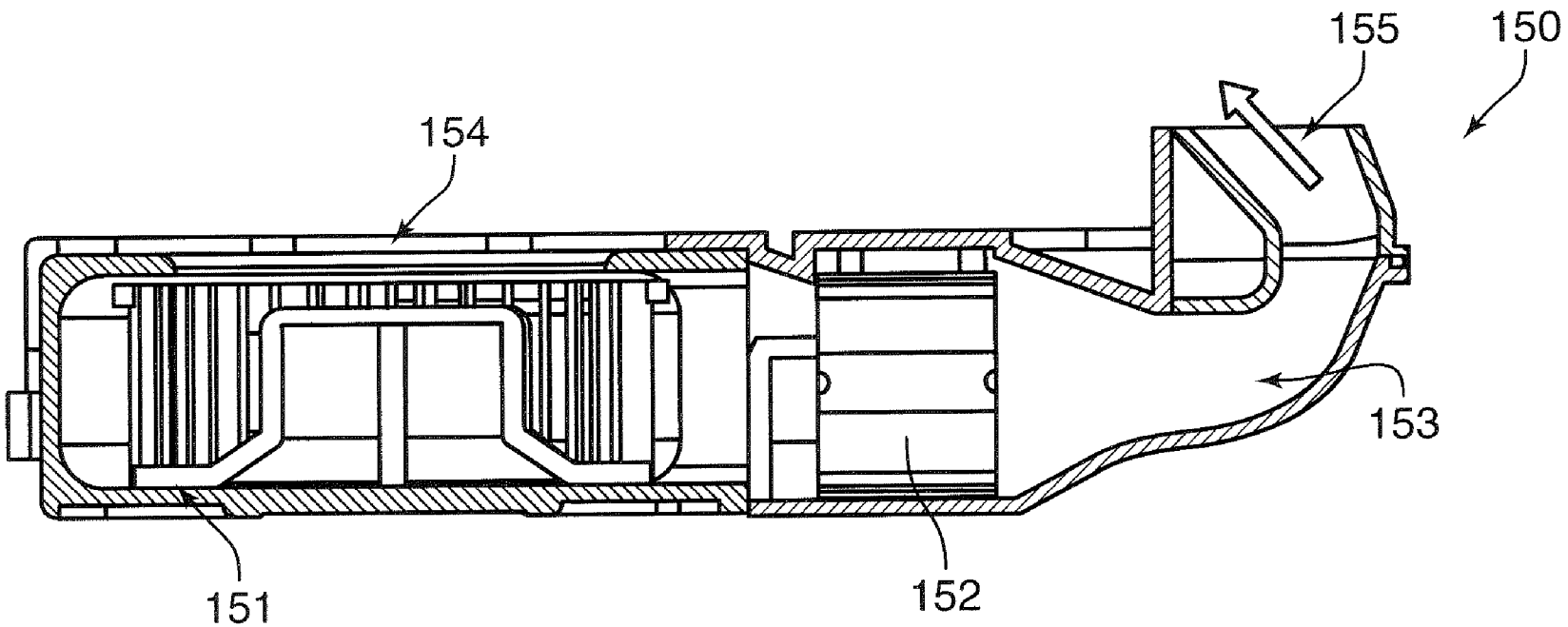
FIG. 7 is a horizontal direction sectional view showing the main parts of a lateral warm air mechanism.
Figure 8:
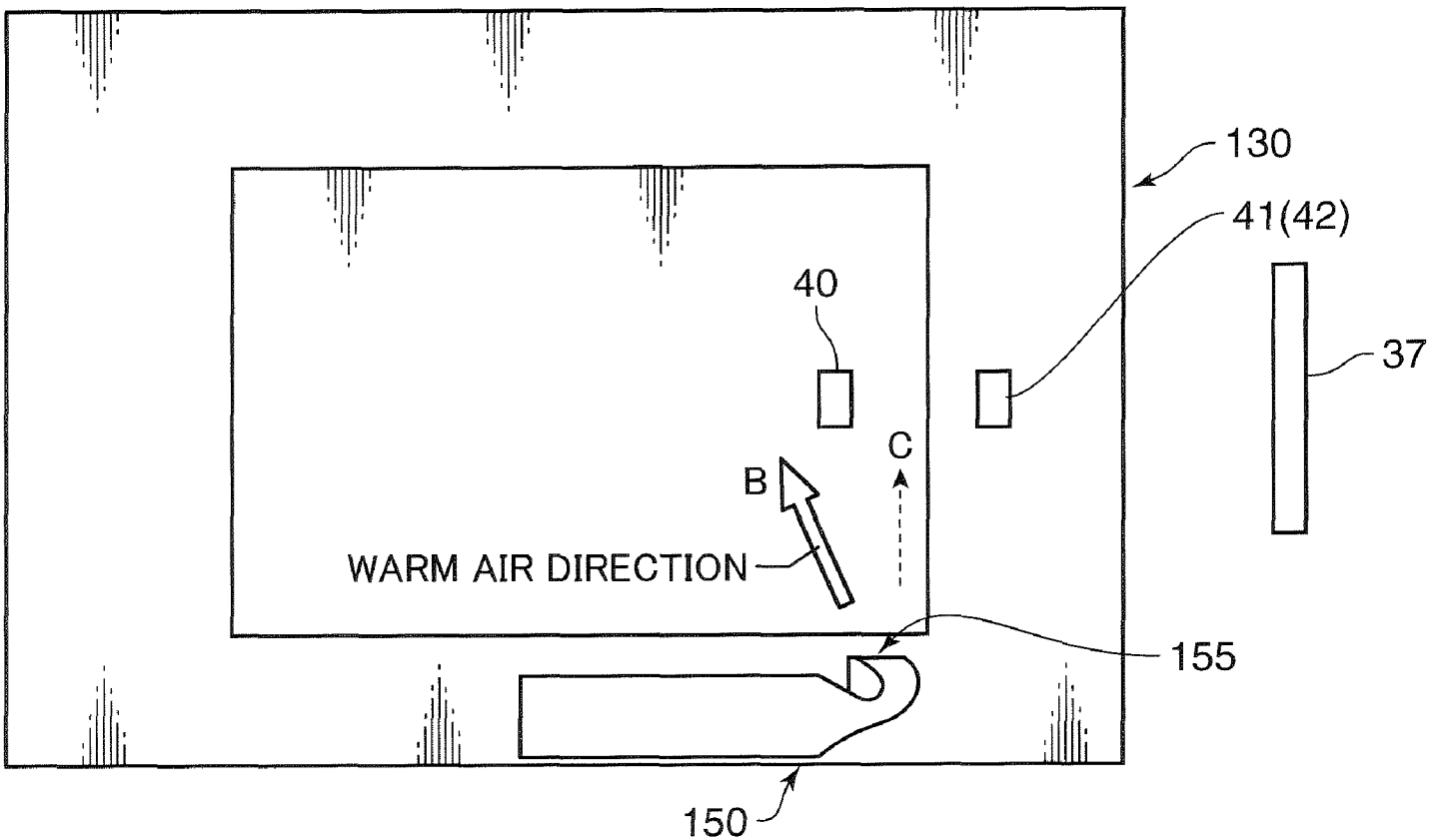
FIG. 8 is an illustrative view showing a warm air blowing direction of the lateral warm air mechanism.
Figure 9B:
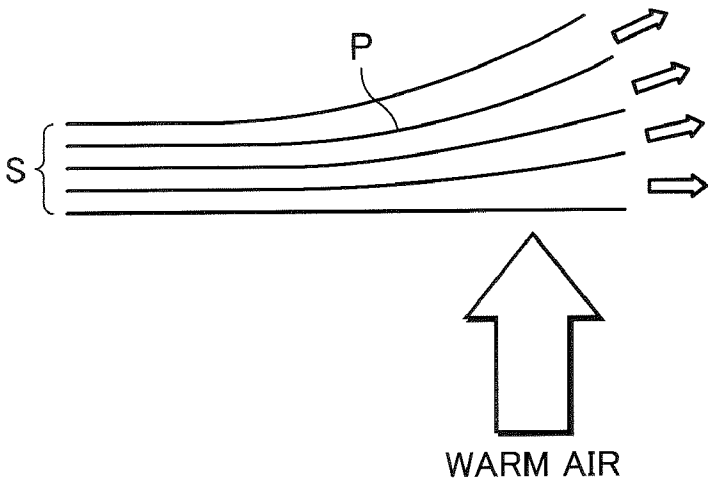
FIGS. 9A and 9B are illustrative views illustrating a warm air blowing condition of the lateral warm air mechanism.
Figure 9A:
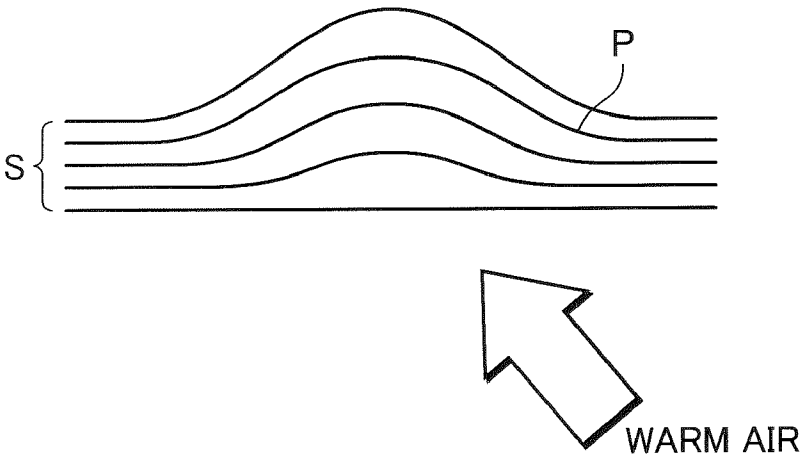

FIG. 6 is a perspective for illustrating the constitution of the sheet feeding unit 130 according to the first embodiment. FIG. 7 is a horizontal direction sectional view showing the main parts of the lateral warm air mechanism 150. FIG. 8 is an illustrative view showing a warm air blowing direction of the lateral warm air mechanism 150. FIGS. 9A and 9B are illustrative views for illustrating a warm air blowing state of the lateral warm air mechanism 150.

The lateral warm air mechanism 150 is provided on the sheet feeding unit main body 130B side. As shown in FIG. 6, a ceiling plate 56 is provided over an upper face of the sheet feeding unit main body 130B such that an upper portion of a sheet accommodating space is sealed by the ceiling plate 56. An opening portion is provided in the ceiling plate 56, and an upper warm air mechanism (second warm air mechanism) described hereinafter is attached to the opening portion.

As shown in FIG. 6, the lateral warm air mechanism is provided along one side face of a sheet feeding cassette 130A in the sheet feeding direction. As shown in FIG. 7, the lateral warm air mechanism 150 includes a first fan 151 and a first heater 152, which are provided in a lateral warm air chamber 153. The lateral warm air mechanism aspirates air from the sheet feeding unit 130 through a first intake port 154 provided in the sheet feeding unit 130. When the first fan 151 is rotated such that the air in the lateral warm air chamber 153 moves to the first heater 152 side, the air in the sheet feeding unit 130 is taken into the lateral warm air chamber 153 through the first intake port 154. The air that moves to the first heater 152 side is heated by the first heater 152 and then blown toward the side face of the sheet stack S through a first warm air blowing port 155.

As shown in FIG. 3, on a vertical cross-section of the sheet conveyance direction, the first warm air blowing port 155 of the lateral warm air mechanism 150 for blowing warm air onto the side face of the sheet stack S in the sheet feeding position is oriented toward a point N at which the pickup roller 40 contacts the upper face of the sheet stack S. Thus, warm air can be applied in a concentrated fashion to the side face of the sheet stack S in exactly the position in which the pickup roller 40 extracts the uppermost sheet, and as a result, warm air can be blown between the sheets in this part efficiently. Hence, the sheet stack S can be loosened efficiently prior to sheet feeding without increasing the size of the lateral warm air mechanism 150.

Moreover, the first warm air blowing port 155 is oriented such that warm air is blown at an angle on a sheet center direction side relative to the width direction of the sheet stack S (an orthogonal direction to the sheet feeding direction, indicated by an arrow C in FIG. 8), as shown by an arrow B in FIG. 8, rather than directly in (parallel to) the width direction of the sheet stack S, as shown in FIG. 8. The reason for this is as follows.

When warm air is blown in the direction of the arrow C in FIG. 8, the warm air escapes to the sheet feeding direction downstream side from the side face of the sheet stack S, as shown in FIG. 9B. As a result, the warm air cannot easily penetrate deeply into the sheet stack S, and therefore the loosening efficiency of the lateral warm air decreases. Hence, in the lateral warm air mechanism 150 according to the this embodiment, the first warm air blowing port 155 is formed to blow warm air toward the center side of the sheet stack S to be fed, as shown by the arrow B in FIG. 8. Thus, as shown in FIG. 9A, the warm air blown from the first warm air blowing port 155 can be trapped between the sheets of the sheet stack S. More specifically, when warm air is blown toward the center side of the sheet stack S, the sheet feeding direction upstream side and downstream side of the sheet stack S sag downward due to the weight of the sheets P, thereby forming a lid, and as a result, the warm air is blown deep into the sheet stack S in a wide range without escaping to the outside. Hence, the sheet stack S can be loosened efficiently prior to sheet feeding using a constant amount of warm air.

Figure 10:
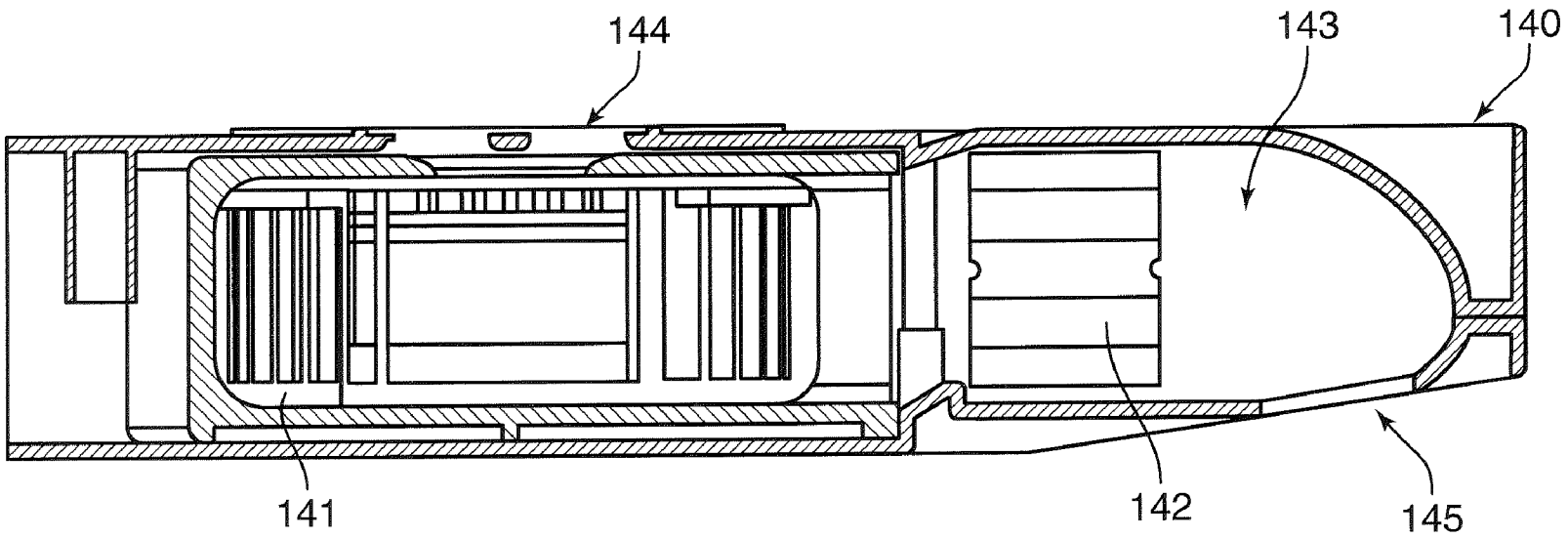
FIG. 10 is a vertical direction sectional view showing the main parts of an upper warm air mechanism.

In addition to the lateral warm air mechanism 150, the sheet feeding unit 130 according to the first embodiment also has the upper warm air mechanism 140 (second warm air mechanism) as a sheet loosening mechanism employing warm air, as shown in FIGS. 2, 3, 6 and 10. FIG. 10 is a vertical direction sectional view showing the constituent of the main parts of the upper warm air mechanism 140.

As with the lateral warm air mechanism 150 described above, the upper warm air mechanism 140 is provided on the sheet feeding unit main body 130B side. The upper warm air mechanism 140 takes in air from a second intake port 144, and blows warm air toward the upper face of the sheet stack S accommodated in the sheet accommodating portion 35 from a second warm air blowing port 145 provided above the upper face of the sheet stack S.

A second fan 141 and a second heater 142 are provided within an upper warm air chamber 143 of the upper warm air mechanism 140. The second intake port 144 is provided in an upper face of the upper warm air chamber 143 above the second fan 141. Specifically, when the second fan 141 rotates, air in the upper warm air chamber 143 moves to the second heater 142 side and outside air is taken into the upper warm air chamber 143 through the second intake port 144. The air that moves to the second heater 142 side is heated by the second heater 142 and blown toward the upper face of the sheet stack S through the second warm air blowing port 145 provided in a lower face of the upper warm air chamber 143. The second warm air blowing port 145 is formed in the upper warm air mechanism 140 on a downstream side of the sheet feeding direction when the upper warm air mechanism 140 is attached to the sheet feeding unit 130.

When a predetermined sheet feeding unit 130 is selected during an image formation operation in the constitution described above, the lift plate 31 is driven to rise, whereby the sheet stack S is raised in the direction of the pickup roller 40, and the upper warm air mechanism 140 is driven to blow warm air toward the upper face of the sheet stack S through the second warm air blowing port 145.

Here, the upper face and peripheral part of the sheet stack S are exposed to outside air and are therefore likely to contain a lot of moisture. In other words, the upper face and side faces of the sheet stack S swell due to moisture absorption, whereas the degree of swelling on the inside of the sheet stack S is lower than that of the upper face and side faces due to the smaller amount of moisture. As a result, a phenomenon occurs whereby pressure on the inside (in the inter-sheet spaces) of the sheet stack S turns negative such that the sheets stick together.

However, according to the sheet feeding unit 130 of this embodiment, a relative humidity of the sheet stack S in the sheet feeding unit 130 (the humidity of the upper face and outer peripheral part of the sheet stack S relative to the other parts) can be reduced instantaneously by providing the upper warm air mechanism 140.

Figure 11:
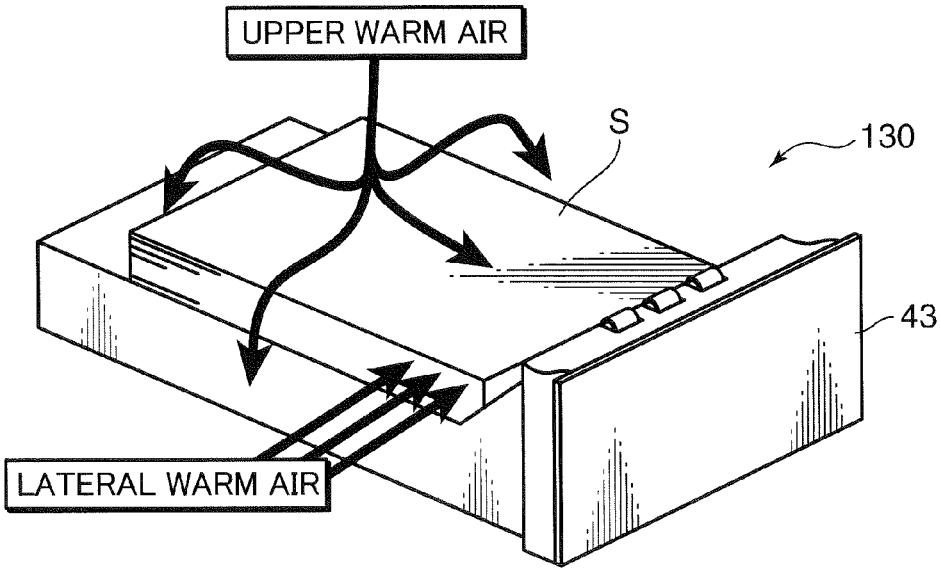
FIG. 11 is a perspective view of a sheet feeding cassette, illustrating lateral warm air and upper warm air blowing directions.

More specifically, the upper warm air mechanism 140 is capable of blowing warm air evenly and in a concentrated fashion from the upper face of the sheet stack S, in which sticking is particularly likely to occur, to the vicinity of the outer periphery (see FIG. 11). As a result, a moisture absorption rate of the upper face and outer peripheral part of the sheet stack S is reduced rapidly, thereby eliminating swelling in these parts. Hence, the relative humidity of the sheet stack S (the humidity of the upper face and outer peripheral part of the sheet stack S relative to the other parts) can be reduced instantly, and negative pressure inside (in the inter-sheet spaces of) the sheet stack S can also be eliminated. Thus, a reduction in sheet sticking force can be achieved, and as a result, the sheet stack S can be loosened efficiently prior to sheet feeding.

Further, as shown in FIG. 3, the upper warm air mechanism 140 is provided on the sheet feeding direction upstream side of the pickup roller 40 and at the rear of the sheet feeding unit 130 in the sheet feeding direction. As noted above, the second warm air blowing port 145 is provided on the sheet feeding direction downstream side of the upper warm air mechanism 140, and therefore warm air can be blown through the second warm air blowing port 145 favorably toward the upper face of the sheet stack S accommodated in the sheet accommodating portion 35.

By disposing the upper warm air mechanism 140 exhibiting high sheet loosening efficiency through effective use of the available space in the sheet feeding unit 130, it is possible to realize a sheet loosening mechanism employing warm air assistance that can be applied to a small sheet feeding device.

More specifically, a constitution in which the sheet stack S carried on the lift plate 31 is raised and lowered using a cantilever elevator mechanism, as in the sheet feeding unit 130 according to this embodiment, is often used in comparatively small sheet feeding devices. When this cantilever elevator mechanism is applied, the sheet feeding direction downstream side on which the pickup roller 40 is provided serves as the side to which the sheet stack S is lifted and the side on which the sheet conveyance mechanism including the pickup roller 40, the sheet feeding roller 41, and so on is provided, and hence little spatial leeway exists. On the other hand, the sheet stack S is not lifted to the sheet feeding direction upstream side, and therefore comparatively large spatial leeway exists on this side. By incorporating the upper warm air mechanism 140 into this space, as in this embodiment, the outer form of the sheet feeding unit 130 does not have to be enlarged to dispose the upper warm air mechanism 140, and therefore the constitution described above can be applied favorably to a small sheet feeding device.

Figure 12A:
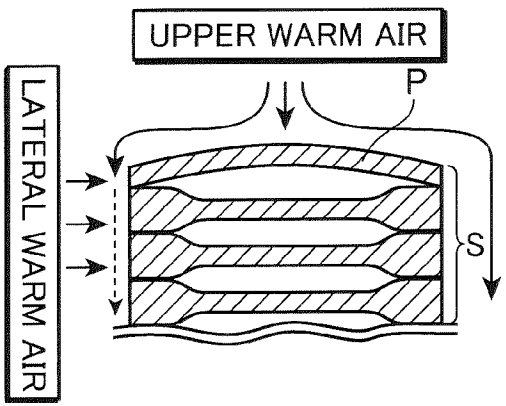
FIGS. 12A, 12B and 12C are illustrative view showing the warm air and upper air blowing directions.
Figure 12B:
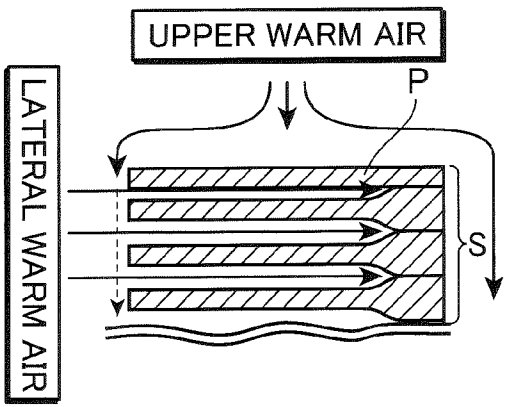
Figure 12C:
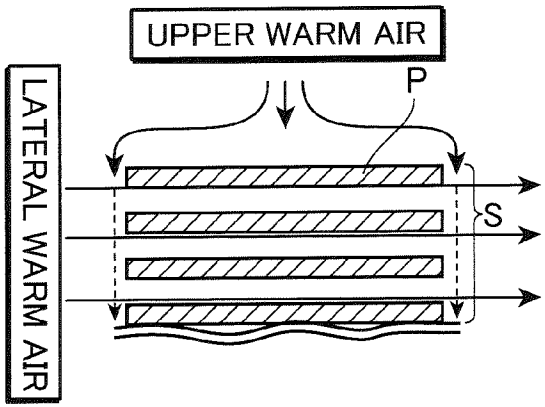

Next, referring to FIGS. 11 to 12C, a sheet loosening effect in the constitution having the lateral warm air mechanism 150 and the upper warm air mechanism 140 is described as the sheet loosening mechanism employing warm air assistance. FIG. 11 is a perspective view of the sheet feeding cassette 130A, illustrating lateral warm air and upper warm air blowing directions. FIGS. 12A to 12C are illustrative views showing the lateral warm air and upper warm air blowing directions with respect to the sheet feeding cassette 130A.

According to the sheet feeding unit 130 of this embodiment, as shown in FIG. 11, warm air is blown toward the upper face of the sheet stack S by the upper warm air mechanism 140 and warm air is blown toward the side face of the sheet stack S in exactly the position in which the pickup roller 40 extracts the uppermost sheet, by the lateral warm air mechanism 150. Hence, in comparison with a constitution including only the lateral warm air mechanism 150, the sheet stack S can be loosened more efficiently prior to sheet feeding.

When a predetermined sheet feeding unit 130 is selected during an image formation operation in the constitution described above, the lift plate 31 is driven to rise, whereby the sheet stack S is raised in the direction of the pickup roller 40, and the upper warm air mechanism 140 is driven to blow warm air toward the upper face of the sheet stack S through the second warm air blowing port 145. Moreover, when a position detection sensor 39 detects that the upper face of the sheet stack S has contacted the pickup roller 40, and therefore that the sheet stack S has risen to the sheet feeding position, the lateral warm air mechanism 150 is driven such that warm air is also blown through the first warm air blowing port 155 toward the side face of the sheet stack S in exactly the position in which the pickup roller 40 extracts the uppermost sheet.

FIGS. 12A to 12C schematically show the degree of efficiency with which the sheet stack S can be loosened by the upper warm air mechanism 140 and the lateral warm air mechanism 150. At first, the upper face and side faces of the sheet stack S are swollen due to moisture absorption, causing the pressure on the inside (in the inter-sheet spaces) of the sheet stack S to turn negative such that the sheets stick together. However, when double warm air blowing is applied by the upper warm air mechanism 140 and the lateral warm air mechanism 150, as shown in FIG. 12A, the condition of the sheet stack S shifts instantly to a state shown in FIG. 12B.

More specifically, the upper warm air mechanism 140 is capable of blowing warm air evenly and in a concentrated fashion from the upper face of the sheet stack S, in which sticking is particularly likely to occur, to the vicinity of the outer periphery. As a result, the moisture absorption rate of the upper face and outer peripheral part of the sheet stack S is reduced rapidly, thereby eliminating swelling in these parts. The swollen state is eliminated first on the upper face of the sheet stack S, which directly receives the warm air blown from the upper warm air mechanism 140, and the side face of the sheet stack S on the lateral warm air mechanism 150 side, which receives warm air from the upper warm air mechanism 140 and the lateral warm air mechanism 150 simultaneously, whereby the state shown in FIG. 12B is achieved, and from this state, the condition of the sheet stack S shifts to a state shown in FIG. 12C (in which the sheet stack S is loosened) instantly.

Hence, when warm air is blown by the upper warm air mechanism 140 and lateral warm air mechanism 150, the swollen state on the side face of the sheet stack S opposite to the lateral warm air mechanism 150 is also eliminated instantaneously, and therefore the warm air from the lateral warm air mechanism 150 passes between the sheets and exits to the exterior of the sheet stack S, thereby loosening the sheet stack S.

Note that the first embodiment describes the constitution in which a combination of a lateral air blowing portion and a heating portion, and a combination or an upper air blowing portion and an upper heating portion are integrally provided in the lateral warm air mechanism 150 and the upper warm air mechanism 140 respectively. However, these members are not necessary provided integrally, and either the air blowing portion or the heating portion may be provided on the sheet feeding cassette 130A and the other on the sheet feeding unit main body 130B.

Figure 14:
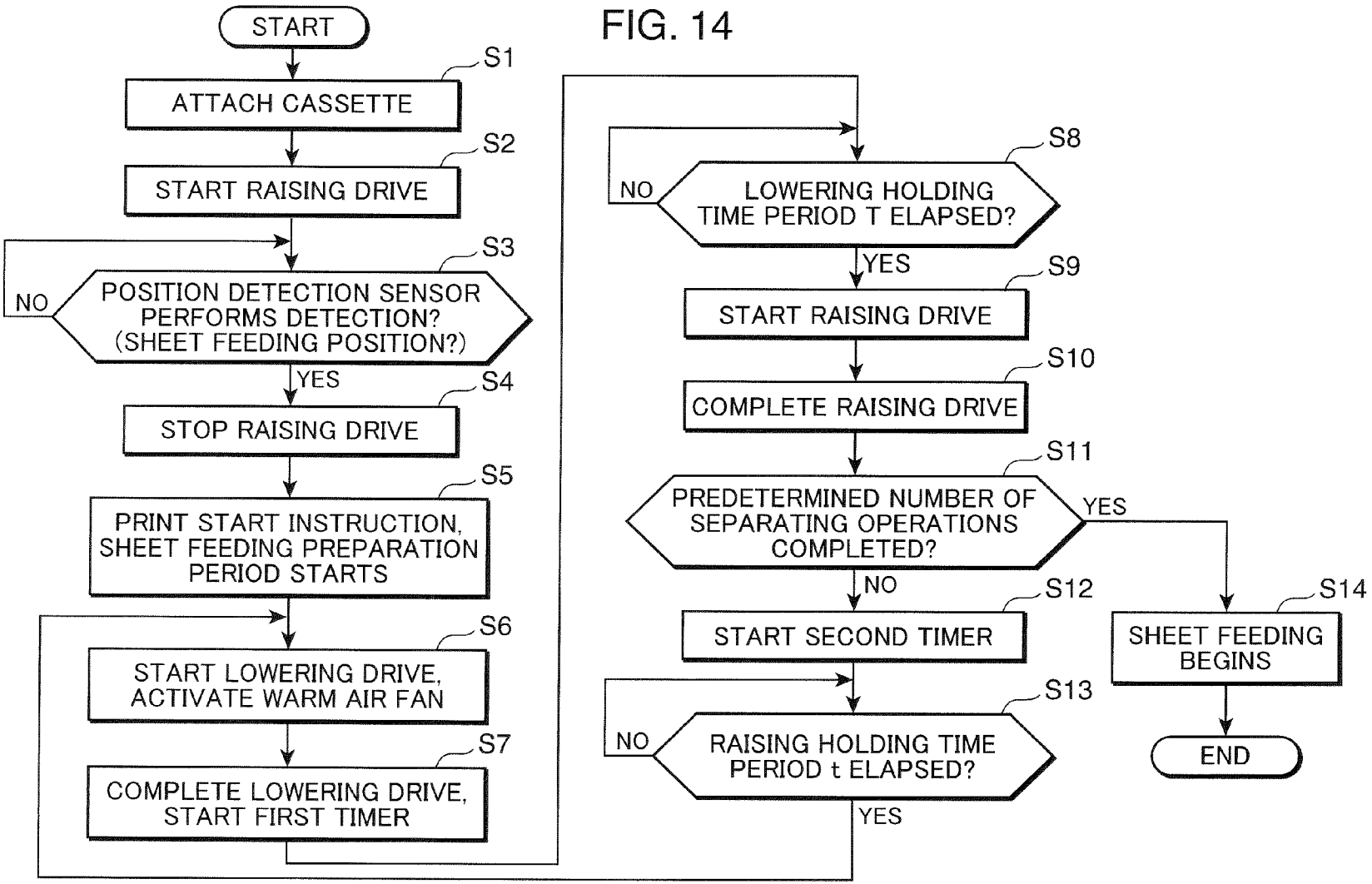
FIG. 14 is a flowchart showing a control operation performed by the controller shown in FIG. 13.
Figure 17:
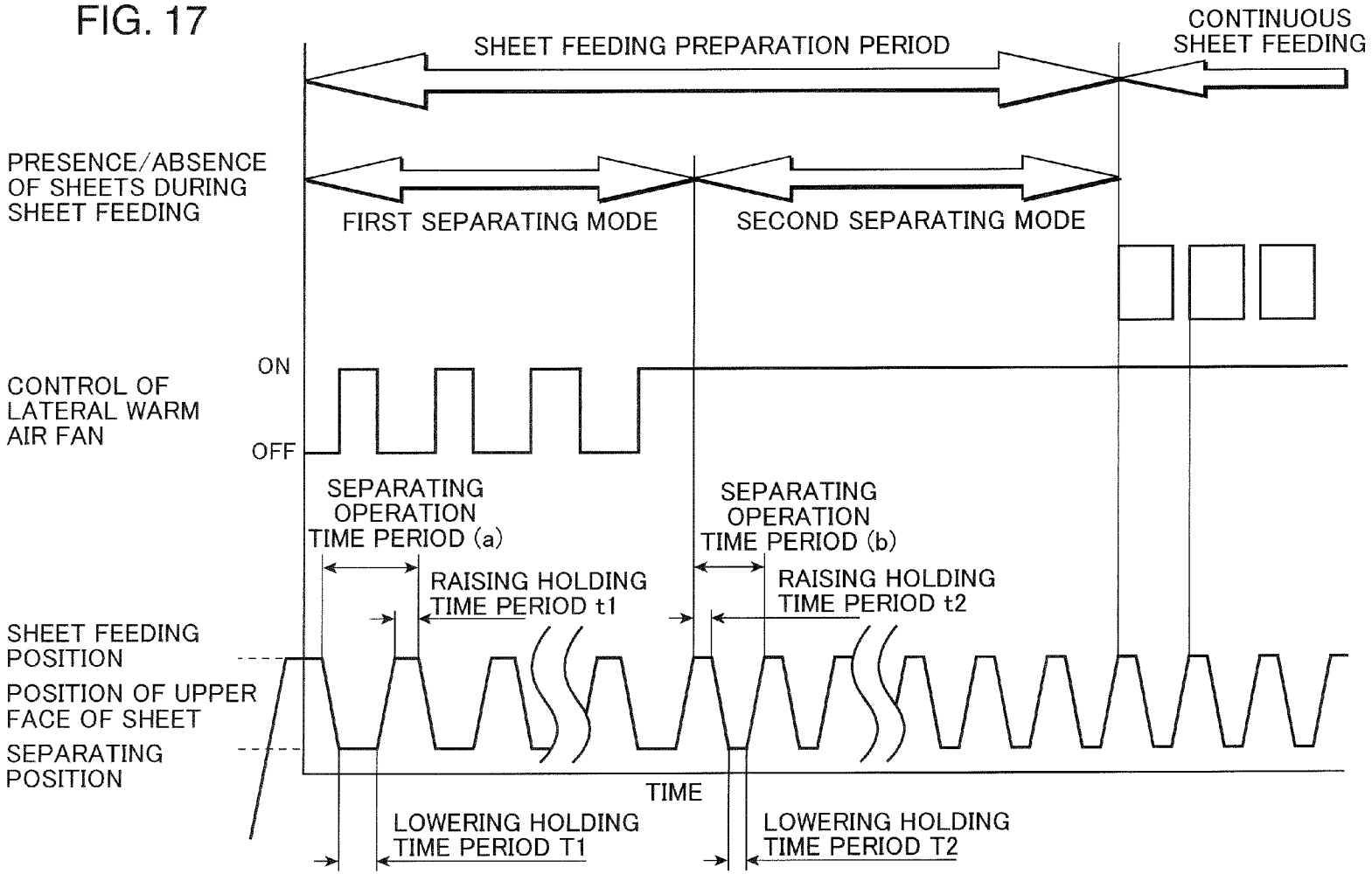
FIG. 17 is a time chart illustrating a control procedure of a warm air blowing operation according to the second embodiment.
Figure 18:
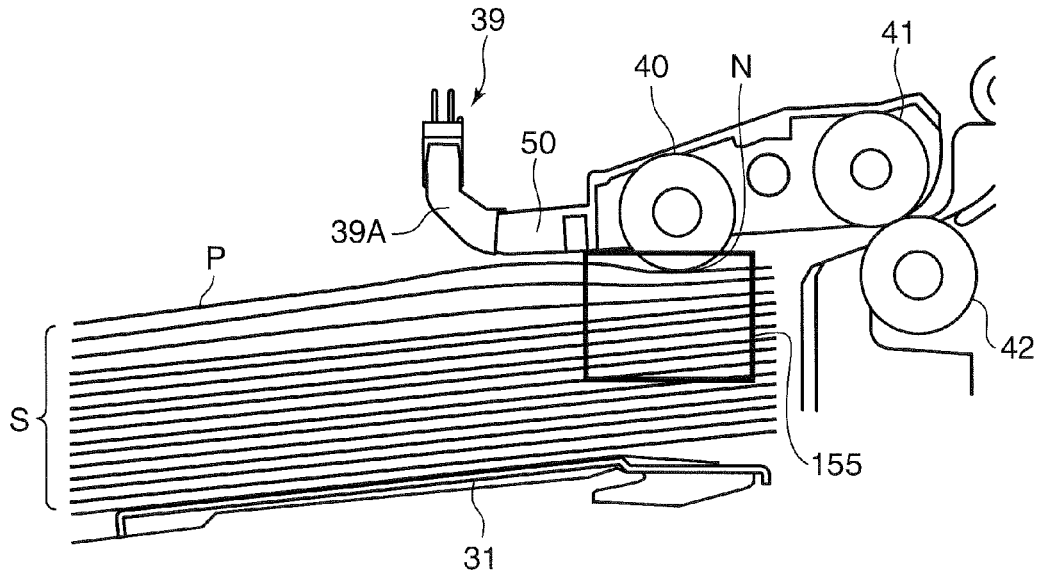
FIGS. 18 to 20 are vertical sectional views of the main parts of a sheet feeding unit, illustrating an operation performed by the sheet feeding devices according to the first and second embodiments.
Figure 19:
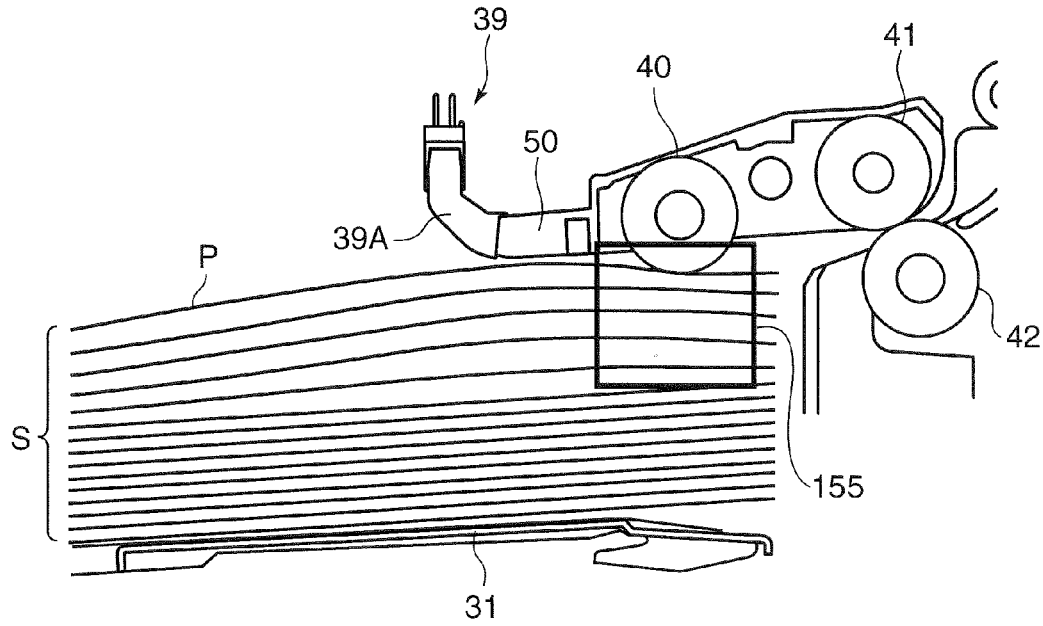
Figure 20:
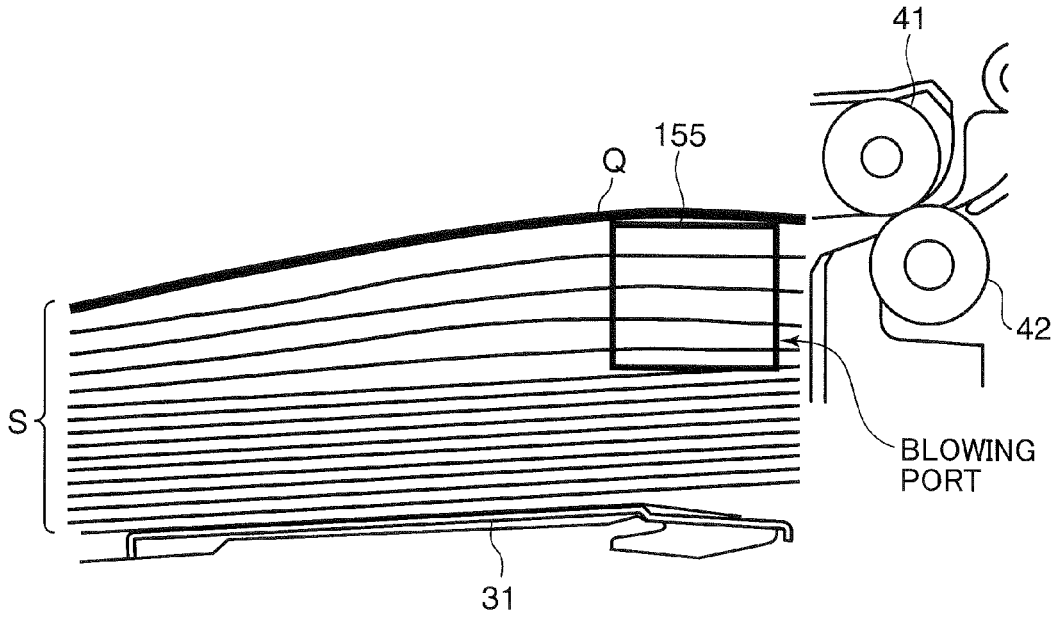

Next, referring to FIGS. 13 to 15 and FIGS. 17 to 19, a control step of a sheet loosening operation employing warm air according to this embodiment will be described. FIG. 13 is a function block diagram showing a controller 300 controlling a warm air blowing operation in the sheet feeding unit 130 according to the first embodiment. FIG. 14 is a flowchart showing a control operation performed by the controller 300 shown in FIG. 13. FIG. 15 is a time chart illustrating the control operation shown in FIG. 14. FIGS. 18 to 20 are vertical sectional views of the main parts of the sheet feeding unit 130, illustrating an operation performed by the sheet feeding unit 130 according to the first embodiment.

In this embodiment, as shown in the time chart of FIG. 15, after the execution of warm air blowing associated with a separating operation for displacing the lift plate 31 between the sheet feeding position and the separating position during a sheet feeding preparation period for actually starting a sheet feeding operation, continuous sheet feeding is carried out. As shown in the function block diagram of FIG. 13, the sheet feeding unit 130 according to this embodiment has the controller 300 that performs, during the sheet feeding preparation period, control for operating the lateral warm air mechanism 150 to blow warm air toward the side face of the sheet stack S and operating the elevator mechanism 30 to cause the lift plate 31 to carry out the separating operation at least once.

Here, the sheet feeding position is a position in which the upper face of the sheet stack S carried on the lift plate 31 contacts the pickup roller 40, and the separating position is a position in which the upper face of the sheet stack S separates from the pickup roller 40 and in which the sheets on the uppermost layer of the sheet stack S that are likely to stick together are lowered to be positioned within the range of the first warm air blowing port 155.

The controller 300 has an information input/output portion 85, a warm air controller 90, an elevator mechanism controller 80, and a storage portion 84. The controller 300 can be constituted by, for example, a CPU, memories (ROM, RAM and so on), an input interface, and an output interface.

A position detection signal from the position detection sensor 39, a rotation drive start signal of the pickup roller 40 from the sheet feeding motor M1, a first time-up signal from a first timer 86, a second time-up signal from a second timer 87, and a cassette selection signal, warm air request signal, a print request signal and the like from a CPU 210 of the printer main body 200 side are input to the information input/output portion 85.

Here, the first timer 86 is a timer that starts timing from when the lift plate 31 is completely lowered and driven to the separating position (FIG. 20). Once timing a predetermined lowering holding time period T (first predetermined time period) after starting timing, the first timer 86 outputs the first time-up signal. Further, the second timer 87 is a timer that starts timing from when the lift plate 31 is completely raised and driven to the sheet feeding position. Once timing a predetermined raising holding time period t (second predetermined time period) after starting timing, the second timer 87 outputs a second time-up signal.

The warm air controller 90 controls the drive of the lateral warm air mechanism 150 and the upper warm air mechanism 140 on the basis of the cassette selection signal and the warm air request signal. Based on these input signals, the warm air controller 90 outputs control signals for driving the lateral warm air mechanism 150 and the upper warm air mechanism 140 to a drive motor (not shown) of each unit through the information input/output portion 85.

The elevator mechanism controller 80 (controller), having a lowering drive determination portion 82 and an raising drive determination portion 83, controls an elevation drive operation performed by the elevator mechanism 30 on the basis of the first time-up signal from the first timer 86 and the second time-up signal from the second timer 87, to cause the elevator mechanism 30 to repeatedly carry out the separating operation for displacing the lift plate 31 between the sheet feeding position and the separating position.

Based on the print request signal, the lowering drive determination portion 82 outputs a control signal for lowering and driving the push-up member 32, to the stepping motor M2 via the information input/output portion 85. Based on the first time-up signal from the first timer 86, the raising drive determination portion 83 outputs a control signal for raising and driving the push-up member 32, to the stepping motor M2 via the information input/output portion 85. Thereafter, based on the second time-up signal from the second timer 87, the lowering drive determination portion 82 outputs the control signal for lowering and driving the push-up member 32, to the stepping motor M2 via the information input/output portion 85.

The storage portion 84 stores therein a plurality of first and second time-up values of the first and second timers 86 and 87 corresponding to, for example, sheet feeding speed, and the size, material and mode of a selected sheet, the number of driving steps of the stepping motor M2 elevating and driving the push-up member 32, and an operation program of each controller. In addition, the storage portion 84 is provided with a storage area for temporarily storing the determination results and other information.

Next, a control procedure performed by the controller 300 during the sheet feeding operation is described with reference to the flowchart shown in FIG. 14.

First, when the sheet feeding cassette 130A is attached to the printer 1 and the cassette selection signal and the warm air request signal are input from the CPU 210 of the printer main body 200 via the information input/output portion 85 (S1), the raising drive determination portion 83 of the elevator mechanism controller 80 outputs the control signal for raising and driving the push-up member 32, to the stepping motor M2 via the information input/output portion 85, on the basis of these input signals. As a result, raising and driving of the push-up member 32 begins (S2).

Next, based on the position detection signal from the position detection sensor 39 (FIGS. 5, 18 and 19), the raising drive determination portion 83 determines whether or not the lift plate 31 is raised and driven up to the sheet feeding position (FIGS. 3 and 18) (S3). The stepping motor M2 continues to raise and drive the push-up member 32 until the lift plate 31 reaches the sheet feeding position. On the other hand, when the raising drive determination portion 83 determines based on the position detection signal that the lift plate 31 is raised to the sheet feeding position (YES in S3), the raising drive determination portion 83 stops the activation of the stepping motor M2, thereby stopping the push-up member 32 from being raised and driven (S4).

Next, when the print request signal from the CPU 210 of the printer main body 200 is input via the information input/output portion 85, the sheet feeding preparation period begins (S5). Based on the print request signal, the lowering drive determination portion 82 outputs the control signal for lowering and driving the push-up member 32, to the stepping motor M2 via the information input/output portion 85. As a result, the stepping motor M2 is activated and lowering and driving of the push-up member 32 begins (S6). At the same time, based on the cassette selection signal and the warm air request signal, the warm air controller 90 outputs control signals for driving the first fan 151 and the first heater 152 of the lateral warm air mechanism 150 and the second fan 141 and the second heater 142 of the upper warm air mechanism 140, to these heaters and fans via the information input/output portion 85 (S6).

In this embodiment, after the warm air blowing operation of the lateral warm air mechanism 150 and the upper warm air mechanism 140 is switched ON in the step S6, control is performed so as not to stop the warm air blowing operation. Instead, ON/OFF control of the first fan 151 may also be performed as described in, for example, a second embodiment described hereinafter.

It is desired that the required number of driving steps of the stepping motor M2 be calculated beforehand in order to lower and drive the push-up member 32 and to displace the lift plate 31 from the sheet feeding position to the separating position, and that the number of driving steps be stored in the storage portion 84. Moreover, a plurality of values corresponding to the type, size and printing speed of a selected sheet may be stored in the storage portion 84 as the number of driving steps such that the lowering drive determination portion 82 can read them appropriately from the storage portion 84 in accordance with the selected condition.

Next, once the lift plate 31 is completely lowered and driven to the separating position (FIG. 20) by the push-up member 32 (completion of lowering and driving by the predetermined number of steps), the lowering drive determination portion 82 performs control so as to stop the stepping motor M2 (to stop the lowering and driving). At the same time, the first timer 86 starts timing (S7).

Thereafter, based on the first time-up signal from the first timer 86, the raising drive determination portion 83 determines whether the predetermined lowering holding time period T (first predetermined time period) has elapsed or not (S8). The first timer 86 continues to time until the lowering holding time period T elapses, and the lift plate 31 is held at the separating position. On the other hand, when the raising drive determination portion 83 determines based on the first time-up signal that the lowering holding time period has elapsed (YES in S8), the raising drive determination portion 83 outputs the control signal for raising and driving the push-up member 32, to the stepping motor M2 via the information input/output portion 85. As a result, the stepping motor M2 is activated and raising and driving of the push-up member 32 begins (S9).

It is desired that the required number of driving steps of the stepping motor M2 be calculated beforehand in order to raise and drive the push-up member 32 and to displace the lift plate 31 from the separating position to the sheet feeding position, and that the number of driving steps be stored in the storage portion 84. Moreover, a plurality of values corresponding to the type, size and printing speed of a selected sheet may be stored in the storage portion 84 as the number of driving steps such that the raising drive determination portion 83 can read them appropriately from the storage portion 84 in accordance with the selected condition.

Next, once the lift plate 31 is completely raised and driven to the sheet feeding position by the push-up member 32 (completion of raising and driving by the predetermined number of steps), the raising drive determination portion 83 performs control so as to stop the stepping motor M2 (to stop the raising and driving) (S10). However, when a predetermined number of separating operations is not finished (NO in S11), the second timer 87 starts timing (S12).

Subsequently, based on the second time-up signal from the second timer 87, the lowering drive determination portion 82 determines whether the predetermined raising holding time period t (second predetermined time period) has elapsed or not (S13). The second timer 87 continues to time until the raising holding time period t elapses, and the lift plate 31 is held at the sheet feeding position. On the other hand, when the lowering drive determination portion 82 determines based on the second time-up signal that the raising holding time period t has elapsed (YES in S13), the lowering drive determination portion 82 outputs the control signal for lowering and driving the push-up member 32, to the stepping motor M2 via the information input/output portion 85. As a result, the stepping motor M2 is activated and lowering and driving of the push-up member 32 begins (S6).

Then, the steps subsequent to the step S7 described above are repeated. Note that when a predetermined number of separating operations is finished subsequently to the step S10 described above (YES in S11), the sheet feeding preparation period ends, and sheet feeding is started (S14).

As described above, the controller 300 of the sheet feeding unit 130 according to the first embodiment controls the drive of the lateral warm air mechanism 150 during the sheet feeding preparation period so as to blow warm air from the first warm air blowing port 155 to the sheet stack S, and controls the operation of the elevator mechanism 30 raising and lowering the lift plate 31 during the sheet feeding preparation period such that the lift plate 31 repeats the separating operation to be displaced between the sheet feeding position and the separating position.

The upper face and a peripheral part of the sheet stack S carried on the lift plate 31 are exposed to outside air, and are therefore likely to contain a large amount of moisture and swell due to moisture absorption. On the other hand, the degree of swelling on the inside of the sheet stack S is relatively lower than that of the upper face and side faces due to the smaller amount of moisture. As a result, pressure inside in the inter-sheet spaces of the sheet stack S turn negative such that the sheets stick together, especially the sheets in an upper layer Q of the sheet stack S (FIG. 20).

Therefore, sticking of the sheets is particularly likely to occur in the upper layer Q than in middle or lower layer of the sheet stack S. For this reason, even when blowing warm air from the first warm air blowing port 155 of the lateral warm air mechanism 150 to the side faces of the sheet stack S that are parallel to the sheet feeding direction, the warm air tends to enter only the sheets of the middle and lower layers in which sticking of the sheets occurs less than in the upper layer Q, whereby the sheets of the upper layer Q in which sticking is likely to occur are lifted up by the warm air while stuck together. Thus, special measures are required as it is particularly difficult to prevent multi-feeding of the sheets in the upper layer Q of the sheet stack S immediately after sheet feeding is started.

In this embodiment, therefore, the controller 300 performs control during the sheet feeding preparation period so as to blow warm air from the first warm air blowing port 155 to the side faces of the sheet stack S, whereby the separating operation for displacing the lift plate 31 between the sheet feeding position and the separating position is repeatedly executed.

More specifically, the controller 300 controls the drive of the elevator mechanism 30 so as to repeat, during the sheet feeding preparation period, the separating operation for lowering the lift plate 31 that is raised to the sheet feeding position in which the upper face of the sheet stack S contacts the pickup roller, to the separating position in which the upper face of the sheet stack S is separated from the pickup roller 40, and then raising the lift plate 31 to the sheet feeding position again. In this manner, during the sheet feeding preparation period, the controller 300 performs control for blowing warm air from the lateral warm air mechanism 150 to the side faces of the sheet stack S that are parallel to the sheet feeding direction, while executing the separating operation for displacing the lift plate 31 between the sheet feeding position and the separating position.

As a result of this control, warm air can be applied to or extracted from the sheets, while changing the sections on the side faces of the sheet stack S where the warm air is blown. As a result of this warm air blowing operation, warm air can be applied to or extracted from the sheets of the sheet stack S while flapping the sheets, so that the warm air can be gradually sent into the sections where the sheets are likely to stick together. Therefore, in comparison with a case where warm air is continuously applied, the warm air sheet loosening efficiency can be improved when the lift plate 31 is secured. As a result, the sheets can be loosened in a short time prior to sheet feeding.

By performing the warm air blowing control associated with the separating operation during the sheet feeding preparation period, the first sheet on the uppermost layer of the sheet stack S can be dispatched to a predetermined conveyance path 133 without being concerned about multi-feeding.

In addition, the controller 300 controls the elevator mechanism 30 so as to hold the lift plate 31 at the separating position for the lowering holding time period T. It is desired that the warm air blowing operation be performed by the lateral warm air mechanism 150 at the sheet feeding position where the upper face of the sheet stack S is separated from the pickup roller 40, so that warm air can be blown into the sheets easily. When the period of time for holding the lift plate 31 at the separating position is too short, warm air cannot be blown into the sheets adequately. Blowing a sufficient amount of warm air can be achieved by holding the lift plate 31 at the separating position for the lowering holding time period T so that the warm air can be blown effectively.

It is preferred that warm air be blown by the upper warm air mechanism 140 by constantly implementing the warm air blowing operation during the sheet feeding preparation period so that the sheets can be loosened efficiently in a short time.

Second Embodiment

Figure 16:
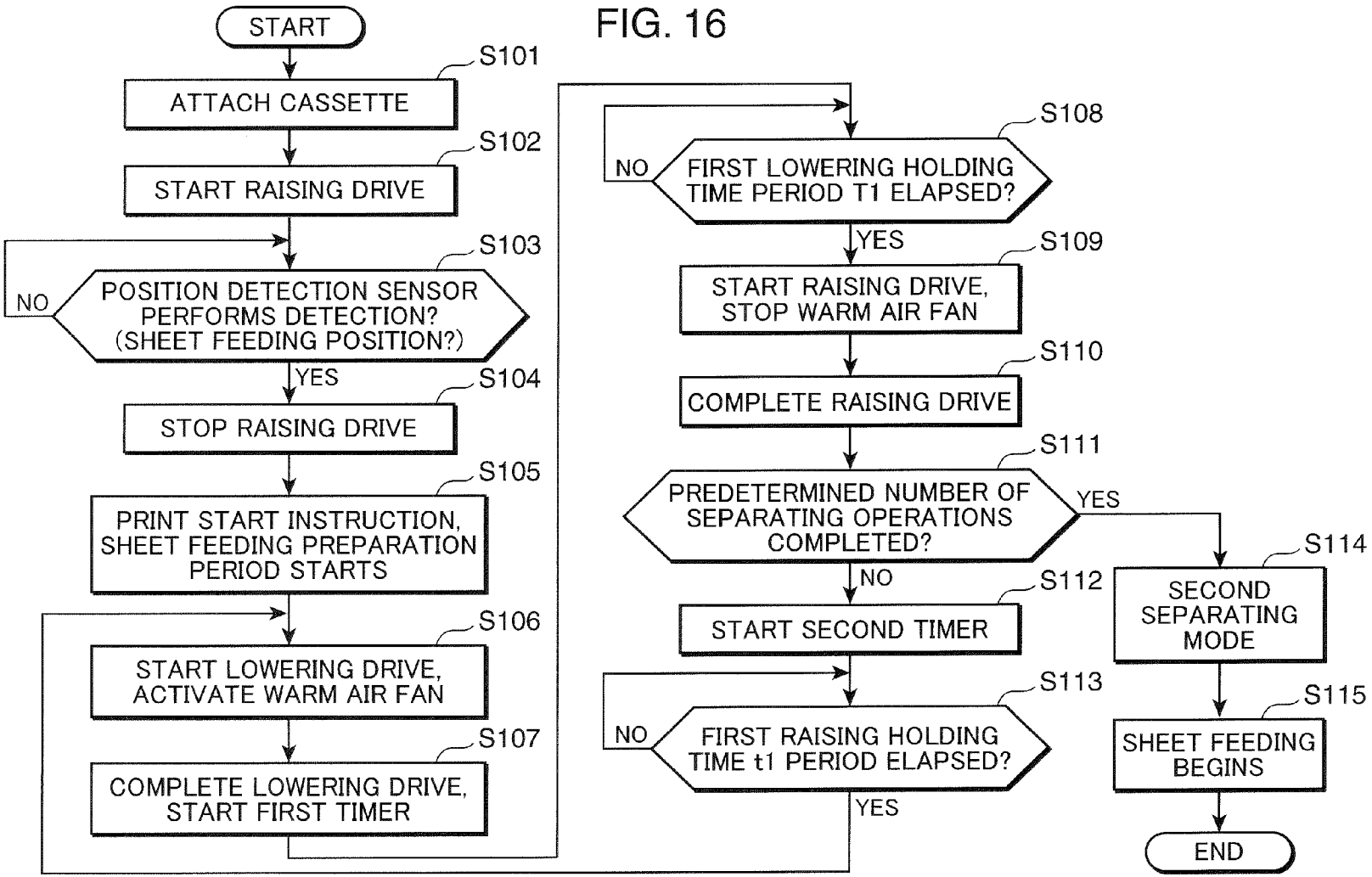
FIG. 16 is a flowchart showing a control operation performed by a controller of a sheet feeding device according to a second embodiment.

Next, a sheet feeding unit according to the second embodiment is described hereinafter with reference to FIGS. 13 and 16 to 20. FIG. 16 is a flowchart showing a control operation according to the second embodiment that is performed by the controller 300 shown in FIG. 13. FIG. 17 is a time chart illustrating a control procedure of a warm air blowing operation according to the second embodiment. Note that the following constitutions other than the constitutions relating to the control performed during the sheet feeding preparation period are the same as those of the first embodiment, and thus the description thereof has been omitted.

In the second embodiment, as shown in the time chart of FIG. 17, a warm air blowing control operation associated with the separating operation performed during the sheet feeding preparation period is carried out in two stages: control in a first mode and control in a second mode.

In the first mode, the controller 300 performs ON/OFF switching control on the warm air blowing operation performed by the lateral warm air mechanism 150. The controller 300 controls the elevator mechanism 30 and the lateral warm air mechanism 150 so as to switch the warm air blowing operation OFF in at least the sheet feeding position and to switch the warm air blowing operation ON in the separating position, in the first mode. After carrying out the first mode control, the controller 300 performs the second mode control.

In the second mode control operation, the controller 300 controls the drive of the elevator mechanism 30 such that the lift plate 31 repeats the separating operation to be displaced between the sheet feeding position and the separating position, and further controls the lateral warm air mechanism 150 so as to constantly switch ON the warm air blowing operation performed by the lateral warm air mechanism 150.

First, a control procedure of the first mode control operation performed during the sheet feeding preparation period is described with reference to the flowchart shown in FIG. 16.

First, when the sheet feeding cassette 130A is attached to the printer 1 and the cassette selection signal and the warm air request signal are input from the CPU 210 of the printer main body 200 via the information input/output portion 85 (S101), the raising drive determination portion 83 of the elevator mechanism controller 80 outputs the control signal for raising and driving the push-up member 32, to the stepping motor M2 via the information input/output portion 85, on the basis of these input signals. As a result, raising and driving of the push-up member 32 begins (S102).

Next, based on the position detection signal from the position detection sensor 39 (FIGS. 3, 18 and 19), the raising drive determination portion 83 determines whether or not the lift plate 31 is raised and driven up to the sheet feeding position (FIGS. 3 and 18) (S103). The stepping motor M2 continues to rise and drive the push-up member 32 until the lift plate 31 reaches the sheet feeding position. On the other hand, when the raising drive determination portion 83 determines based on the position detection signal that the lift plate 31 is raised to the sheet feeding position (YES in S103), the raising drive determination portion 83 stops the activation of the stepping motor M2, thereby stopping the push-up member 32 from being raised and driven (S104).

Next, when the print request signal from the CPU 210 of the printer main body 200 is input via the information input/output portion 85, the sheet feeding preparation period begins (S105). Based on the print request signal, the lowering drive determination portion 82 outputs the control signal for lowering and driving the push-up member 32, to the stepping motor M2 via the information input/output portion 85. As a result, the stepping motor M2 is activated and lowering and driving of the push-up member 32 begins (S106).

At the same time, based on the cassette selection signal and the warm air request signal, the warm air controller 90 outputs control signals for driving the first fan 151 and the first heater 152 of the lateral warm air mechanism 150 and the second fan 141 and the second heater 142 of the upper warm air mechanism 140, to a motor (not shown) driving the first fan 151 and the first heater 152, and to a motor (not shown) driving the second fan 141 and the second heater 142, via the information input/output portion 85.

Next, once the lift plate 31 is completely lowered and driven to the separating position by the push-up member 32 (completion of lowering and driving by the predetermined number of steps), the lowering drive determination portion 82 performs control so as to stop the stepping motor M2 (to stop the lowering and driving). At the same time, the first timer 86 is started (S107).

Thereafter, based on the first time-up signal from the first timer 86, the raising drive determination portion 83 determines whether the predetermined lowering holding time period T1 (first lowering holding time period) has elapsed or not (S108). The first timer 86 continues to time until the lowering holding time period T1 elapses, and the lift plate 31 is held at the separating position. On the other hand, when the raising drive determination portion 83 determines based on the first time-up signal that the lowering holding time period T1 has elapsed (YES in S108), the raising drive determination portion 83 outputs the control signal for raising and driving the push-up member 32, to the stepping motor M2 via the information input/output portion 85. As a result, the stepping motor M2 is activated and raising and driving of the push-up member 32 begins (S109).

Unlike the first embodiment, in the second embodiment the raising and driving to the separating position is started in the step S109, and at the same time the warm air controller 90 outputs, based on the first time-up signal, a control signal for stopping the drive of the first fan 151 of the lateral warm air mechanism 150, to the first fan 151 via the information input/output portion 85.

It is desired that the control be performed such that the warm air blowing operation performed by the lateral warm air mechanism 150 during the sheet feeding preparation period is switched OFF in at least the sheet feeding position. Specifically, in the sheet feeding position, even if the sheets of the upper layer Q in which sticking is likely to occur are lifted up by the warm air while stuck together (FIG. 20), the upper layer Q can be lowered again and positioned within the range of the first warm air blowing port 155 to which the warm air is applied, by switching the warm air blowing operation OFF in the sheet feeding position. Therefore, by starting the raising and driving of the push-up member 32 and at the same time stopping (switching OFF) the drive of the lateral warm air mechanism 150 in the step S109, the warm air blowing operation can be turned OFF in at least the sheet feeding position, even when taking into consideration inertial rotation of the first fan 151.

It is desired that the timing of switching the warm air blowing operation OFF be adjusted (advanced or delayed) in consideration of the amount of air applied to the inertia of the first fan 151, such that the upper layer Q that is lifted up by the warm air descends simultaneously with the descent of the lift plate 31.

Next, once the lift plate 31 is completely raised and driven to the sheet feeding position by the push-up member 32 (completion of raising and driving by the predetermined number of steps), the raising drive determination portion 83 performs control so as to stop the stepping motor M2 (to stop the raising and driving) (S110). However, when a predetermined number of separating operations is not finished (NO in S111), the second timer 87 starts timing (S112).

Based on the second time-up signal from the second timer 87, the lowering drive determination portion 82 determines whether the predetermined raising holding time period t1 (first raising holing time period) has elapsed or not (S113). The second timer 87 continues to time until the raising holding time period t1 elapses, and the lift plate 31 is held at the sheet feeding position. On the other hand, when the lowering drive determination portion 82 determines based on the second time-up signal that the raising holding time period t1 has elapsed (YES in S113), the lowering drive determination portion 82 outputs the control signal for lowering and driving the push-up member 32, to the stepping motor M2 via the information input/output portion 85. As a result, the stepping motor M2 is activated and lowering and driving of the push-up member 32 begins (S106).

Then, the steps subsequent to the step S107 described above are repeated. Note that when a predetermined number of separating operations is finished subsequently to the step S110 described above (YES in S111), the second mode control operation is performed (S114). Upon completion of the second mode control operation, sheet feeding begins (S115).

Unlike the first embodiment, in the second embodiment the lowering and driving to the separating position is started in the step S106, and at the same time the warm air controller 90 outputs a control signal for driving the first fan 151 of the lateral warm air mechanism 150, to the first fan 151 via the information input/output portion 85.

It is desired that the control be performed such that the warm air blowing operation performed by the lateral warm air mechanism 150 during the sheet feeding preparation period is switched ON in at least the separating position. This is because warm air can be blown into the sheets effectively in the separating position to which the lift plate 31 is lowered. Therefore, by starting the lowering and driving of the push-up member 32 and at the same time starting (switching ON) the drive of the warm blowing operation performed by the lateral warm air mechanism 150 in the step S106, a desired amount of warm air can be blown in at least the separating position, even when taking into consideration delay in the activation of the first fan 151 and the first heater 152.

Note that the timing of activating the first fan 151 may be earlier than the timing of starting the lowering and driving of the push-up member 32, in consideration of the delay in the activation of the first fan 151 (a time lag between the activation and when air actually reaches an effective level).

In the first mode control operation associated with the ON/OFF switching of the warm air blowing operation performed by the lateral warm air mechanism 150, even if the sheets of the upper layer Q in which sticking is likely to occur are lifted up by the warm air while stuck together (FIG. 20), the upper layer Q can be lowered again and positioned within the range of the first warm air blowing port 155 to which the warm air is applied favorably, by switching the warm air blowing operation OFF in the sheet feeding position.

However, in the first mode, because the raising/lowering timing in the separating operation is determined in consideration of the activation delay of the first fan 151 and the inertial rotation of the first fan 151 when stopped, one cycle between the start of the lowering and driving and the next start of the lowering and driving (a separating operation time period (a)) becomes long, as shown in the time chart of FIG. 17. In other words, the number of times the separating operation is performed is reduced during the period in which the first mode control operation is performed.

In the second embodiment, therefore, the sheets of the upper layer Q in which sticking is likely to occur is loosened to some extent in the first mode control operation, and then the second mode control operation is performed in which the warm air blowing operation of the lateral warm air mechanism 150 is constantly ON. Because the second mode is not associated with the ON/OFF switching control performed on the warm air blowing operation, the ON/OFF control can be performed in a shorter cycle (a separating operation time period (b)) than the first mode.

Therefore, one cycle between the start of the lowering and driving and the next start of the lowering and driving in the second mode (the separating operation time period (b)) can be made shorter than the one cycle between the start of the lowering and driving and the next start of the lowering and driving in the first mode (the separating operation time period (a)). Specifically, in the second mode, a raising holding time period t2 during which the lift plate 31 is held at the sheet feeding position can be made shorter than the raising holding time period t1 of the first mode. Similarly, a lowering holding time period T2 during which the lift plate 31 is held at the separating position can be made shorter than the lowering holding time period T1 of the first mode. Hence, the number of times the separating operation is performed can be increased, in comparison with when the first mode control operation is performed.

According to the second embodiment, warm air can be blown toward the side faces of the sheet stack S that are parallel to the sheet feeding direction, while repeating, in a short cycle, the separating operation in which lift plate 31 is displaced between the sheet feeding position and the separating position. Therefore, warm air can be applied to or extracted from the sheets, while changing the sections on the side faces of the sheet stack S where the warm air is blown. As a result, warm air can be applied to or extracted from the sheets of the sheet stack S while flapping the sheets, so that the warm air can be gradually and efficiently sent into the sections where the sheets are likely to stick together. Thus, in comparison with a case where the lift plate 31 remains secured or separated and moved in a long cycle, the warm air sheet loosening efficiency can be improved. As a result, the sheets can be loosened in a short time prior to sheet feeding.

It is preferred that the warm air blowing operation performed by the upper warm air mechanism 140 be constantly ON in both the first mode and the second mode so that the sheets can be loosened efficiently in a short time. Although it is desired that the second mode control operation be performed immediately after the first mode control operation, only the first mode control operation may be performed or only the second mode control operation may be performed.

Third Embodiment

Figure 21:
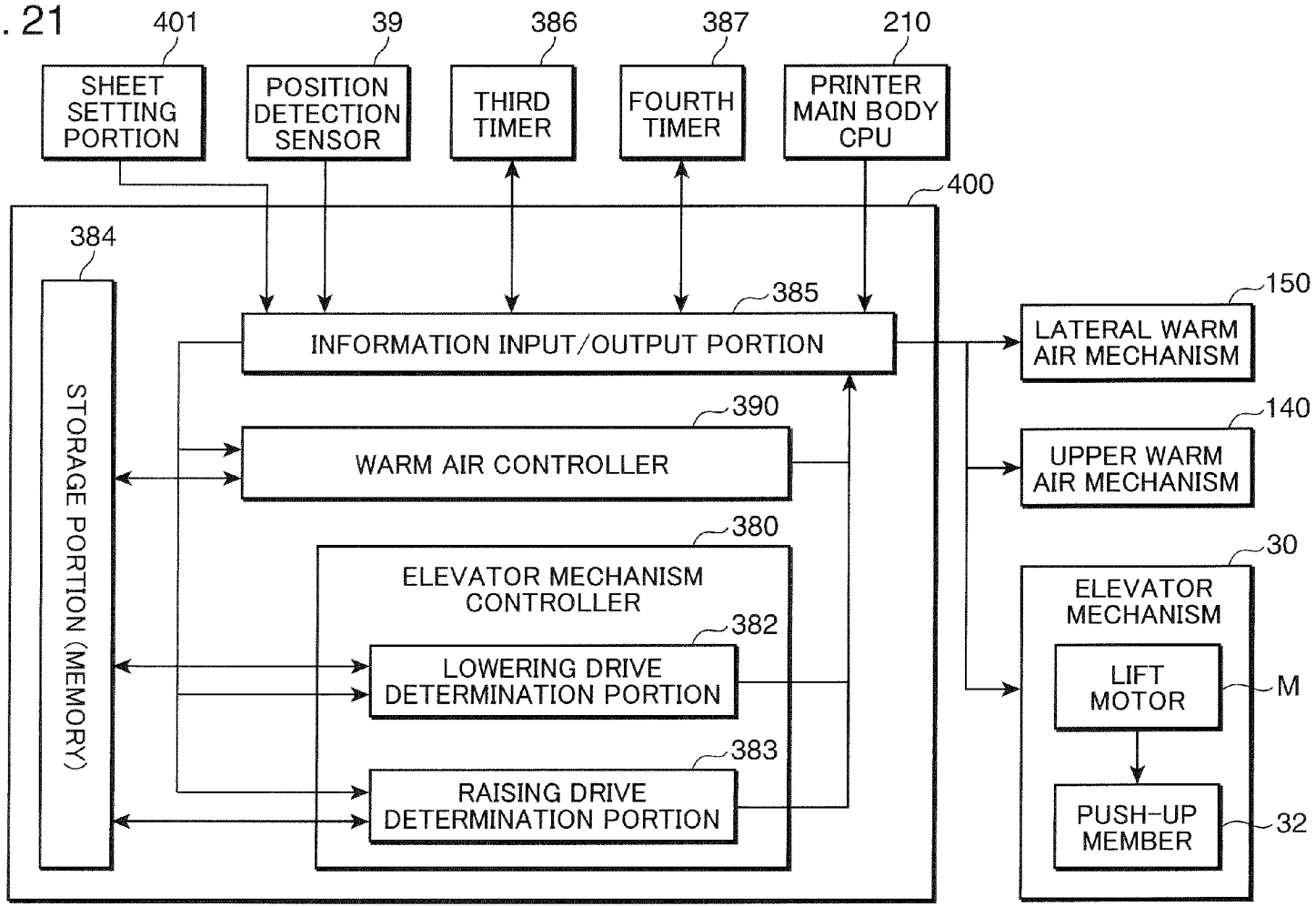
FIG. 21 is a function block diagram of a controller controlling a warm air blowing operation in a sheet feeding device according to a third embodiment.
Figure 22:
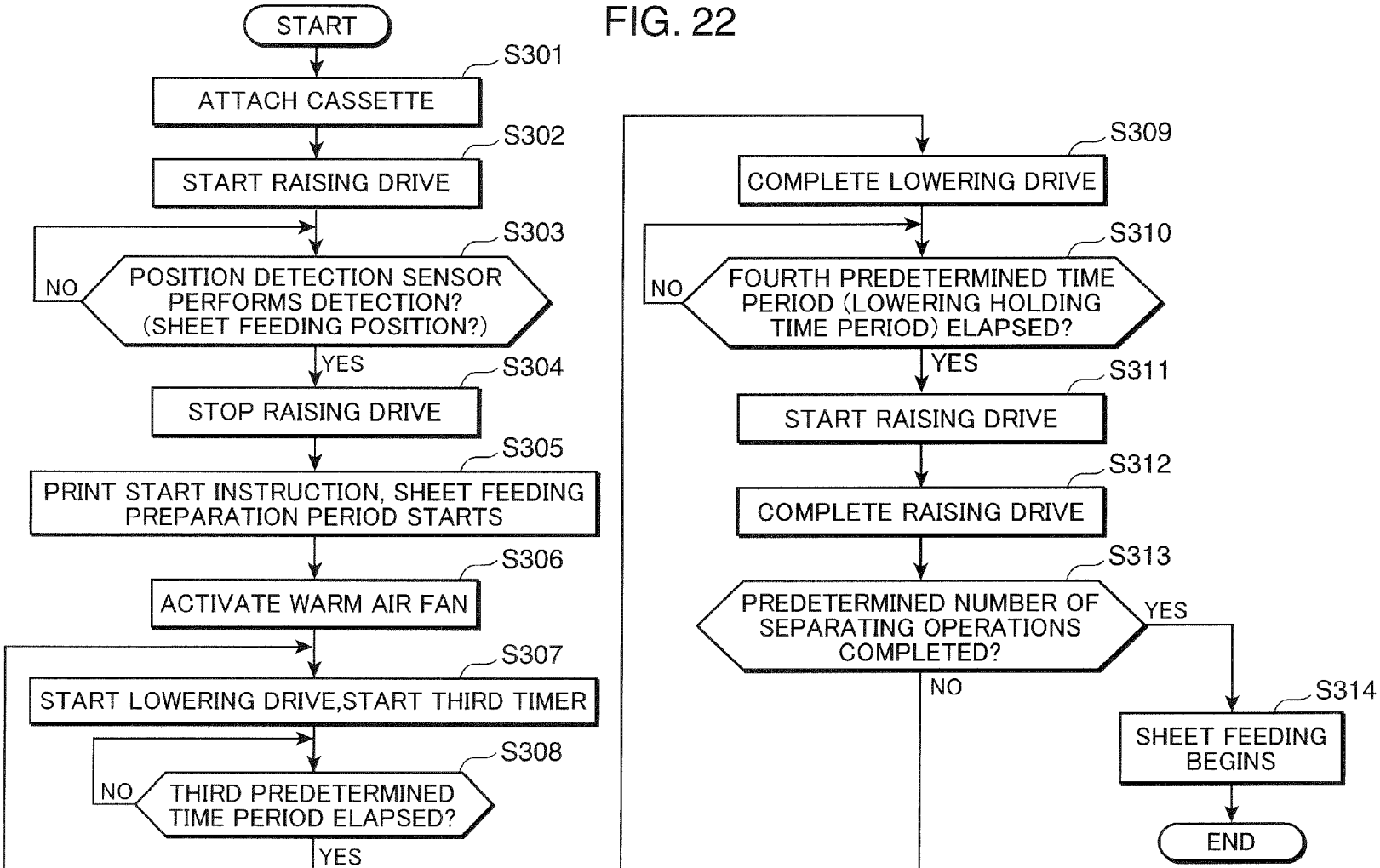
FIG. 22 is a flowchart showing a control operation performed by the controller shown in FIG. 21.
Figure 23:
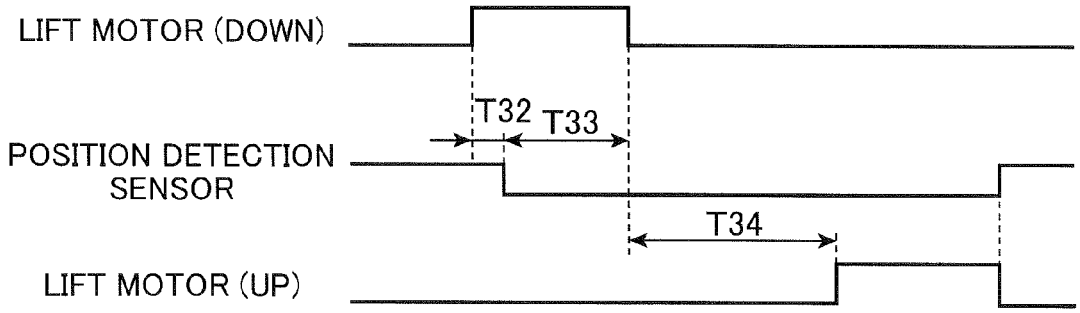
FIG. 23 is a time chart illustrating the control operation shown in FIG. 22.

Next, a sheet feeding unit (sheet feeding device) according to a third embodiment is described. The third embodiment illustrates a control example in which the lift plate 31 is lowered to the appropriate separating position in accordance with the type of the sheet P to be fed. FIG. 21 is a function block diagram of a controller 400 controlling a warm air blowing operation in the sheet feeding unit according to a third embodiment. FIG. 22 is a flowchart showing a control operation performed by the controller 400. FIG. 23 is a time chart illustrating the control operation.

In the third embodiment, a sheet setting portion 401 (a sheet specifying portion) for specifying the type of the sheets P is provided. In addition, a third timer 386 (timer) and a fourth timer 387 are also provided. The third timer 386 is a timer for timing a time period from when lowering of the lift plate 31 is started. Once timing a predetermined time period (third predetermined time period) after starting timing, the third timer 386 outputs a third time-up signal. The fourth timer 387 is a timer for timing a time period from when lowering of the lift plate 31 to the separating position is completed. Once timing a predetermined time period (fourth predetermined time period) after starting timing, the fourth timer 387 outputs a fourth time-up signal.

As shown in FIG. 21, and as with the embodiments described above, the sheet feeding unit according to the third embodiment has the controller 400 that controls to perform the warm air blowing operation during the sheet feeding preparation period, while repeating the separating operation for displacing the lift plate 31 between the sheet feeding position and the separating position. The controller 400 changes the degree of lowering in accordance with the type of sheets P selected as the sheets to be fed. Therefore, for example, when a sheet P that is unlikely to be lifted up due to its high basis weight (the weight per unit area) is selected, the degree of lowering is set low. In this manner, the sheet P can be lowered to the appropriate separating position in accordance with the type of the sheet P to be fed.

As a result, in comparison with a case where the separating position is fixed regardless of the type of the sheet P to be fed, warm air can be blown into the sheet stack S more efficiently, and, as shown in FIG. 18, the sheets P on the uppermost layer of the sheet stack can be loosened when starting the sheet feeding operation. Accordingly, the sheets can be dispatched, from the first sheet P on the uppermost layer, to a predetermined conveyance path without reducing the sheet feeding speed or without being concerned about multi-feeding.

The type of the sheet P to be fed can be selected by, for example, the sheet setting portion 401 provided on an operation panel (not shown) of the sheet feeding unit 130 or the printer main body 200. Alternatively, a reflective sensor (not shown), for example, may be used for directly detecting the type of the sheet P to be fed.

Note that the type of the sheet P to be fed can be classified by, for example, the following TABLE.1 based on the basis weight (the weight per unit area) Dp of the sheet P. In TABLE.1, the sheet P to be fed is taken as a coat sheet and is classified into two types by thickness, the thicker one being at the top and the thinner one at the bottom.

TABLE 1

| Basis Weight Dp (g/m$^2$) | Lowering Drive Time Period during Sheet Feeding Preparation Period (mS) |
|---|---|
| Dp ≦ 135 | 600 |
| 135 < Dp | 500 |

Specifying the type of sheet P to be fed in this embodiment means not only specifying standard paper, coat paper, a film sheet, a tracing paper, or other type of sheet P, and also specifying the type of sheet P based on the difference in thickness (basis weight) between sheets of the same type (coat paper, for example), as shown in the example of TABLE.1.

As described above, by changing the degree of lowering in accordance with the type of sheet P selected as the sheet to be fed, and by carrying out the separating operation for displacing the lift plate 31 between the sheet feeding position and the separating position during the sheet feeding preparation period, as shown in FIGS. 18 to 20, even a small amount of warm air can be easily and efficiently blown into the sections of the sheet stack S that are away from the first warm air blowing port 155.

As shown in FIG. 21, the controller 400 has an information input/output portion 385, a warm air controller 390, an elevator mechanism controller 380, and a storage portion 384.

A sheet type signal from the sheet setting portion 401, a position detection signal from the position detection sensor 39, the third time-up signal from the third timer 386, the fourth time-up signal from the fourth timer 387, and the warm air request signal and a sheet feeding command signal from the CPU 210 of the printer main body 200 are input to the information input/output portion 385.

The warm air controller 390 controls the drive of the lateral warm air mechanism 150 and the upper warm air mechanism 140 on the basis of the sheet feeding command signal and the warm air request signal. Based on these input signals, the warm air controller 390 outputs the control signals for driving the lateral warm air mechanism 150 and the upper warm air mechanism 140 to drive motors (not shown) of the both warm air mechanisms 140, 150 through the information input/output portion 385.

The elevator mechanism controller 380, having a lowering drive determination portion 382 and an raising drive determination portion 383, controls an elevation drive operation performed by the elevator mechanism 30 on the basis of the third time-up signal from the third timer 386 and the fourth time-up signal from the fourth timer 387, to cause the elevator mechanism 30 to carry out the separating operation for displacing the lift plate 31 between the sheet feeding position and the separating position.

Based on the sheet type signal and the third time-up signal, the lowering drive determination portion 382 outputs the control signal for lowering and driving the push-up member 32, to a lift motor M via the information input/output portion 385. Based on the sheet feeding command signal and the fourth time-up signal, the raising drive determination portion 383 outputs the control signal for raising and driving the lift plate 31 by means of the push-up member 32, to the lift motor M via the information input/output portion 385.

The storage portion 384 stores therein, for example, a third time-up value of the third timer 386 and a fourth time-up value of the fourth timer 387, which correspond to the type of sheet to be fed that is selected by the sheet setting portion 401, and an operation program of each controller. In addition, the storage portion 384 is provided with a storage area for temporarily storing the determination results and other information.

Next, referring to the flowchart shown in FIG. 22, the control operation performed by the controller 400 according to the third embodiment will be described.

First, when the sheet feeding cassette 130A is attached to the color printer 1 (S301), the raising drive determination portion 383 of the elevator mechanism controller 380 outputs the control signal for raising and driving the lift plate 31 by means of the push-up member 32, to the lift motor M via the information input/output portion 385. As a result, raising and driving of the lift plate 31 begins (S302). The raising drive determination portion 383 then outputs the control signal for raising and driving the lift plate 31 by means of the push-up member 32, to the lift motor M via the information input/output portion 385.

Next, when the raising drive determination portion 383 determines based on the position detection signal from the position detection sensor 39 whether or not the lift plate 31 is raised and driven up to the sheet feeding position (S303), the raising drive determination portion 383 stops the activation of the lift motor M. As a result, the lift plate 31 is stopped from being raised and driven (S304). The lift plate 31 stands by in this state until a sheet feed command is issued. When the sheet feeding command signal and the sheet type signal are input via the information input/output portion 385, the sheet feeding preparation period begins (S305). At the same time, based on the sheet feeding command signal and the warm air request signal, the warm air controller 390 outputs control signals for driving the first fan 151 and the first heater 152 of the lateral warm air mechanism 150 and the second fan 141 and the second heater 142 of the upper warm air mechanism 140, to these heaters and fans via the information input/output portion 385 (S306).

Next, the lowering drive determination portion 382 starts lowering and driving the lift plate 31. Further, based on the sheet type signal from the sheet setting portion 401, the lowering drive determination portion 382 reads from the storage portion 384 the lowering drive time period corresponding to the type of a selected sheet as the third predetermined time period, and starts the third timer 386 (S307). The lowering drive determination portion 382 then continues to lower and drive the lift plate 31 during the third predetermined time period.

Note that the lowering drive time period may be timed when the lowering and driving of the lift plate 31 is started or when the position detection sensor 39 is switched OFF (when the upper face of the sheet stack S is separated from the pickup roller 40 after a lapse of a predetermined time period from the start of the lowering and driving of the lift plate 31 (T32 in FIG. 23)), as shown by T33 in FIG. 23.

More specifically, based on the third time-up signal from the third timer 386, the lowering drive determination portion 382 determines whether the third predetermined time period set beforehand has elapsed or not (S308). When the lowering drive determination portion 382 determines based on the third time-up signal that the third predetermined time period has elapsed (YES in S308), the lowering drive determination portion 382 stops the activation of the lift motor M to stop the lift plate 31 from being lowered and driven (S309).

However, when the lift plate 31 continues to be lowered and driven even a predetermined limit time period has elapsed after the start of the lowering and driving, the controller 400 desirably controls the elevator mechanism 30 so as to forcibly stop the lift plate 31 from being lowered and driven.

Normally, because the upper face of the sheet stack S is separated from the pickup roller 40 after a lapse of a predetermined time period after the elevator mechanism 30 starts lowering and driving the lift plate 31, the position detection portion 39 becomes unable to detect. However, for example, when a plurality of sheets P including the sheet P to be fed get stuck between the sheet feeding roller 41 and the loosening roller 42 provided below the sheet feeding roller 41 as a result of a paper jam or the like, and the upper face of the sheet stack S cannot be separated from the pickup roller 40, the position detection portion 39 continuously detects that the upper face of the sheet stack S is in the sheet feeding position. In this case, the third timer 386 for timing the lowering drive time period is not activated, and the elevator mechanism 30 continues to lower and drive the lift plate 31, causing damage to the sheet feeding unit 130.

Therefore, after the elevator mechanism 30 starts lowering and driving the lift plate 31, when the lowering and driving is continued even after a lapse of the predetermined limit time period, the lift plate 31 is forcibly stopped from being lowered and driven. As a result, the sheet feeding unit 130 can be prevented from being damaged by the continuous lowering of the lift plate 31 after a lapse of the predetermined limit time period. Note that the predetermined limit time period may be set shorter than a time period required for the lift plate 31 to reach the lowermost position (withdrawn position) from when the lift plate 31 starts to be lowered and driven.

Next, based on the fourth time-up signal from the fourth timer 387, the raising drive determination portion 383 determines whether a fourth predetermined time period (the lowering holding time period: T34 in FIG. 23) set beforehand has elapsed or not (S310). The fourth timer 387 continues to time until the fourth predetermined time period elapses, and the lift plate 31 is held at the separating position. On the other hand, when the raising drive determination portion 383 determines based on the fourth time-up signal that the fourth predetermined time period has elapsed (YES in S310), the raising drive determination portion 383 outputs the control signal for raising and driving the lift plate 31 by means of the push-up member 32, to the lift motor M via the information input/output portion 385. As a result, the lift motor M is activated and the push-up member 32 starts raising and driving the lift plate 31 (S311).

Next, when it is detected based on the position detection signal from the position detection sensor 39 that the push-up member 32 has completed raising and driving the lift plate 31 to the sheet feeding position, the raising drive determination portion 383 performs control to stop the lift motor M (to stop the raising and driving) (S312).

Whether the predetermined number of separating operations has been completed or not is checked (S313). When the predetermined number of separating operations is not completed (NO in S313), the separating operation for raising and driving the lift plate 31 between the sheet feeding position and the separating position (S307 to S312) is repeated. When the predetermined number of separating operations is completed (YES in S313), the sheet feeding operation is started (S314).

As described above, the controller 400 provided in the sheet feeding unit according to the third embodiment changes the degree of lowering of the lift plate 31 in accordance with the type of sheet P selected by the sheet setting portion 401. Therefore, for example, when a sheet P that is unlikely to be lifted up due to its high basis weight (the weight per unit area) is selected, the degree of lowering is set low. In this manner, the sheet P can be lowered to the appropriate separating position in accordance with the type of the sheet P to be fed. As a result, in comparison with a case where the separating position is fixed regardless of the type of the sheet P to be fed, warm air can be blown into the sheet stack S more efficiently, and the sheets P on the uppermost layer of the sheet stack S can be loosened when starting the sheet feeding operation. Accordingly, the first sheet P can be dispatched to a predetermined conveyance path without reducing the sheet feeding speed or without being concerned about multi-feeding.

Moreover, by changing the degree of lowering in accordance with the type of the selected sheet P, and by carrying out the separating operation performed between the sheet feeding position and the separating position during the sheet feeding preparation period, even a small amount of warm air can be easily blown into the sections of the sheet stack S that are away from the first warm air blowing port 155. Hence, it is possible to realize a warm air assistance mechanism exhibiting higher sheet loosening efficiency than a conventional large warm air assistance mechanism. Thus, a reduction in the size of the entire sheet feeding device can be achieved.

INDUSTRIAL APPLICABILITY

The sheet feeding device according to the present invention may be applied to all types of image forming apparatuses, such as printers, copiers, facsimiles, and compound machines including the functions thereof in composite, and may be used particularly favorably in a small image forming apparatus.

Note that the specific embodiments described above mainly include the inventions having the following constitutions.

A sheet feeding device according to one aspect of the present invention is a sheet feeding device for feeding a sheet, including a sheet accommodating portion for accommodating a sheet stack constituted by a plurality of sheets, a sheet carrying plate provided in the sheet accommodating portion and carrying the sheet stack, a pickup roller that contacts an upper face of the sheet stack and dispatches the sheet of an uppermost layer of the sheet stack, an elevator mechanism that displaces the sheet carrying plate between a sheet feeding position in which the upper face of the sheet stack contacts the pickup roller and a separating position in which the upper face of the sheet stack is separated from the pickup roller, a first warm air mechanism for blowing warm air toward a side face of the sheet stack accommodated in the sheet accommodating portion, the side face being parallel to the sheet feeding direction, and a controller for controlling the operation of the elevator mechanism and the operation of the first warm air mechanism during a sheet feeding preparation period before starting a sheet feeding operation for feeding a first sheet of the sheet stack, wherein the controller performs control for operating the first warm air mechanism to blow warm air to the side face of the sheet stack and operating the elevator mechanism to cause the elevator mechanism to carry out, at least once, a separating operation for displacing the sheet carrying plate between the sheet feeding position and the separating position.

According to this constitution, the controller performs control for blowing warm air from the first warm air mechanism to the side face of the sheet stack that is parallel to the sheet feeding direction, while executing the separating operation for displacing the sheet carrying plate between the sheet feeding position and the separating position during the sheet feeding preparation period. As a result, warm air can be applied to or extracted from the sheets, while changing the sections on the side faces of the sheet stack where the warm air is blown. Specifically, warm air can be applied to or extracted from the sheets of the sheet stack while flapping the sheet of the sheet stack, so that the warm air can be gradually sent into the sections where the sheets are likely to stick together. Therefore, in comparison with a case where warm air is continuously applied when the sheet carrying plate is secured, the warm air sheet loosening efficiency can be improved. Therefore, the sheet feeding preparation period can be shortened.

By performing the warm air blowing control associated with the separating operation during the sheet feeding preparation period, the uppermost sheet of the sheet stack, which is the first sheet of the sheet stack, can be dispatched to a downstream conveyance path without causing multi-feeding.

In the constitution described above, it is desired that the controller control the elevator mechanism so as to hold the sheet carrying plate at the separating position for the first predetermined time period. According to this constitution, warm air can be blown into the sheet stack at the separating position effectively.

Further, it is preferred that the controller control the elevator mechanism so as to hold the sheet carrying plate at the sheet feeding position for the second predetermined time period. According to this constitution, when the pickup roller lets out the sheet, the sheet can be securely pressed against the pickup roller. Therefore, the sheet can be dispatched to a desired conveyance path in a stable manner.

In the constitution described above, It is desired that, during the sheet feeding preparation period, the controller control the first warm air mechanism in a first mode for switching ON/OFF the warm air blowing operation performed by the first warm air mechanism, and that the controller control the elevator mechanism and the first warm air mechanism so as to, in the first mode, switch OFF the warm air blowing operation in at least the sheet feeding position, and switch ON the warm air blowing operation in the separating position.

According to this constitution, in the sheet feeding position, even when the sheets of the upper layer in which the sheets are likely to stick together are lifted up by the warm air while stuck together, the warm air blowing operation is OFF in the sheet feeding position. Therefore, the upper layer can be lowered. Further, because the warm air blowing operation is switched ON in the separating position, warm air can be blown into the sheets effectively.

In the constitution described above, during the sheet feeding preparation period, after controlling the elevator mechanism and the first warm air mechanism in the first mode, the controller carries out control in a second mode. In the second mode, it is desired that the controller control the drive of the elevator mechanism so as to repeat the separating operation for displacing the sheet carrying plate between the sheet feeding position and the separating position, and control the first warm air mechanism such that the warm air blowing operation performed by the first warm air mechanism is constantly ON.

According to the constitution described above, after performing control in the first mode to somewhat loosen the sheets of the upper layer in which the sheets are likely to stick together, control in the second mode is performed in which the warm air blowing operation performed by the first warm air mechanism is constantly ON. As a result, the sheets of the sheet stack can be loosened efficiently in a short time prior to sheet feeding.

In this case, it is desired that the controller control the elevator mechanism so as to carry out the separating operation in a shorter cycle in the second mode than in the first mode. According to this constitution, the required amount of warm air to be blow and the number of times the separating operation is performed are secured, and therefore the sheets can be loosened efficiently in a shorter period.

In the constitution described above, it is desired that the sheet feeding device further have a second warm air mechanism for blowing warm air toward the upper surface of the sheet stack accommodated in the sheet accommodating portion, and that the controller control the second warm air mechanism so as to blow warm air from the second warm air mechanism to the upper surface of the sheet stack during the sheet feeding preparation period. In this case, it is particularly desired that the controller control the second warm air mechanism to blow warm air from the second warm air mechanism to the upper surface of the sheet stack during the whole period of the sheet feeding preparation period.

According to this constitution, because the sheet loosening effect can be further enhanced, the sheet feeding preparation period can be reduced more.

In the constitution described above, it is desired that the sheet feeding device further have a sheet specifying portion for specifying a type of the sheet to be fed, and that the controller control the elevator mechanism to change the degree of lowering the sheet carrying plate in accordance with the type of the sheet specified by the sheet specifying portion.

According to this constitution, in comparison with a case where the separating position is fixed regardless of the type of the sheet to be fed, warm air can be blown into the sheet stack more efficiently, and the sheets of the uppermost layer of the sheet stack can be loosened when starting the sheet feeding operation. Accordingly, the first sheet can be dispatched to a predetermined conveyance path without reducing the sheet feeding speed or without being concerned about multi-feeding.

In the constitution described above, the sheet feeding device has a position detection portion for detecting that the upper face of the sheet stack is in the sheet feeding position, a storage portion for storing each lowering drive time period corresponding to the degree of lowering corresponding to the type of the sheet specified by the sheet specifying portion, and a timer for timing the each lowering drive time period, wherein the controller reads, from the storage portion, the lowering drive time period corresponding to the type of sheet specified by the sheet specifying portion, and controls the elevator mechanism to lower the sheet carrying plate until the timer, which starts timing from when the position detection portion no longer detects that the upper face of the sheet stack is in the sheet feeding position, times the lowering drive time period read from the storage portion, after the elevator mechanism is caused to start lowering and driving of the sheet carrying plate.

According to this constitution, lowering and driving of the sheet carrying plate can be securely executed by the elevator mechanism in accordance with the type of the sheet.

In the constitution described above, when the lowering and driving of the sheet carrying plate continues even when a predetermined time period elapses after lowering of the sheet carrying plate is started, it is desired that the controller control the elevator mechanism to stop the lowering and driving. According to this constitution, the sheet feeding device can be prevented from being damaged, by continuing to lowering and driving the sheet carrying plate even the predetermined time period elapses.

In the constitution described above, it is desired that the elevator mechanism further include a push-up member for pushing up the sheet carrying plate, wherein a sheet feeding direction upstream side end of the sheet carrying plate is supported rotatably within the sheet accommodating portion, one end of the push-up member is supported rotatably by a drive shaft, and the other end thereof contacts a bottom surface of the sheet carrying plate to push up the sheet carrying plate.

A cantilever elevator mechanism described above (a mechanism for using the elevator mechanism to raise and lower the sheet carrying plate, the sheet feeding direction upstream side end of which is rotatably supported) is often used in comparatively small sheet feeding devices. It is difficult to install the sheet loosening mechanism of a large warm air mechanism into such a small sheet feeding device, for the reason of limited space. Therefore, it is favorable to adopt a warm air mechanism that can use even a small amount of warm air to efficiently loosen the sheets accommodated in the sheet accommodating portion, prior to sheet feeding.

In the constitution described above, it is desired that the elevator mechanism include a stepping motor for forwardly and reversely rotating the drive shaft, and the sheet feeding device further includes a storage portion for storing a number of lowering steps corresponding to the degree of lowering corresponding to the weight of each type of sheet specified by the sheet specifying portion and a sheet specifying portion for specifying a type of the sheet to be fed, wherein the controller reads, from the storage portion, the number of lowering steps of the stepping motor that corresponds to the type of sheet specified by the sheet specifying portion, and controls a lowering and driving operation performed by the elevator mechanism, so as to rotate the stepping motor by the number of lowering steps corresponding to the sheet.

An image forming apparatus according to another aspect of the present invention has the sheet feeding device having each of the constitutions described above, and an image forming apparatus main body for forming an image on the sheet fed from the sheet feeding device.

According to the constitution described above, it is possible to realize a warm air unit exhibiting higher sheet loosening efficiency than a conventional large warm air assistance mechanism. Thus, a reduction in the size of the entire sheet feeding device can be achieved. Consequently, a reduction in the size of the entire image forming apparatus that has the sheet feeding device with the warm air sheet loosening mechanism can be achieved.

As described above, the present invention can provide a sheet feeding device that has a sheet loosening mechanism employing warm air assistance and can be set even in a small space by improving the warm air sheet loosening efficiency, as well as an image forming apparatus having the sheet feeding device.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet feeding device for feeding a sheet, comprising:

a sheet accommodating portion for accommodating a sheet stack constituted by a plurality of sheets;

a sheet carrying plate provided in the sheet accommodating portion and carrying the sheet stack;

a pickup roller that contacts an upper face of the sheet stack and dispatches the sheet of an uppermost layer of the sheet stack;

an elevator mechanism that displaces the sheet carrying plate between a sheet feeding position in which the upper face of the sheet stack contacts the pickup roller and a separating position in which the upper face of the sheet stack is separated from the pickup roller;

a first heated air mechanism for blowing heated air toward a side face of the sheet stack accommodated in the sheet accommodating portion, the side face being parallel to the sheet feeding direction; and a controller for controlling the operation of the elevator mechanism and the operation of the first heated air mechanism during a sheet feeding preparation period before starting a sheet feeding operation for feeding a first sheet of the sheet stack, wherein the controller simultaneously performs, during the sheet feeding preparation period, control for operating the first heated air mechanism to blow heated air to the side face of the sheet stack and control for operating the elevator mechanism to cause the elevator mechanism to carry out, at least once, a separating operation for displacing the sheet carrying plate between the sheet feeding position and the separating position.

2. The sheet feeding device according to claim 1, wherein the controller controls the elevator mechanism so as to hold the sheet carrying plate at the separating position for a first predetermined time period.

3. The sheet feeding device according to claim 1, wherein the controller controls the elevator mechanism so as to hold the sheet carrying plate at the sheet feeding position for a second predetermined time period.

4. The sheet feeding device according to claim 1, wherein, during the sheet feeding preparation period, the controller controls the first heated air mechanism in a first mode for switching on and off a heated air blowing operation performed by the first heated air mechanism, and controls the elevator mechanism and the first heated air mechanism so as to, in the first mode, switch off the heated air blowing operation in at least the sheet feeding position, and switch on the heated air blowing operation in the separating position.

5. The sheet feeding device according to claim 4, wherein during the sheet feeding preparation period, after controlling the elevator mechanism and the first heated air mechanism in the first mode, the controller carries out control in a second mode, and in the second mode, the controller controls drive of the elevator mechanism so as to repeat the separating operation for displacing the sheet carrying plate between the sheet feeding position and the separating position, and controls the first heated air mechanism such that the heated air blowing operation performed by the first heated air mechanism is constantly on.

6. The sheet feeding device according to claim 5, wherein the controller controls the elevator mechanism so as to carry out the separating operation in a shorter cycle in the second mode than in the first mode.

7. The sheet feeding device according to claim 1, further comprising:

a second heated air mechanism for blowing heated air toward the upper surface of the sheet stack accommodated in the sheet accommodating portion, wherein the controller controls the second heated air mechanism so as to blow heated air from the second heated air mechanism to the upper surface of the sheet stack during the sheet feeding preparation period.

8. The sheet feeding device according to claim 7, wherein the controller controls the second heated air mechanism to blow heated air from the second heated air mechanism to the upper surface of the sheet stack during all of the sheet feeding preparation period.

9. The sheet feeding device according to claim 1, further comprising:

a sheet specifying portion for specifying a type of the sheet to be fed, wherein the controller controls the elevator mechanism to change the degree of lowering the sheet carrying plate in accordance with the type of the sheet specified by the sheet specifying portion.

10. The sheet feeding device according to claim 9, further comprising:

a position detection portion for detecting that the upper face of the sheet stack is in the sheet feeding position;

a storage portion for storing each lowering drive time period corresponding to the degree of lowering corresponding to the type of the sheet specified by the sheet specifying portion; and a timer for timing the each lowering drive time period, wherein the controller reads, from the storage portion, the lowering drive time period corresponding to the type of sheet specified by the sheet specifying portion, and controls the elevator mechanism to lower the sheet carrying plate until the timer, which starts timing from when the position detection portion no longer detects that the upper face of the sheet stack is in the sheet feeding position, times the lowering drive time period read from the storage portion, after the elevator mechanism is caused to start lowering and driving of the sheet carrying plate.

11. The sheet feeding device according to claim 9, wherein the controller controls the elevator mechanism so as to stop lowering the sheet carrying plate, when lowering of the sheet carrying plate continues even when a predetermined time period elapses after the elevator mechanism is caused to start lowering of the sheet carrying plate.

12. The sheet feeding device according to claim 1, wherein the elevator mechanism has a push-up member for pushing up the sheet carrying plate, a sheet feeding direction upstream side end of the sheet carrying plate is supported rotatably within the sheet accommodating portion, and wherein one end of the push-up member is supported rotatably by a drive shaft, and the other end thereof contacts a bottom surface of the sheet carrying plate to push up the sheet carrying plate.

13. The sheet feeding device according to claim 12, wherein the elevator mechanism has a stepping motor for forwardly and reversely rotating the drive shaft, the sheet feeding device further comprising:

a sheet specifying portion for specifying a type of the sheet to be fed;

a storage portion for storing a number of lowering steps corresponding to the degree of lowering corresponding to the weight of each type of sheet specified by the sheet specifying portion; and wherein the controller reads, from the storage portion, the number of lowering steps of the stepping motor that corresponds to the type of sheet specified by the sheet specifying portion, and controls a lowering and driving operation performed by the elevator mechanism, so as to rotate the stepping motor by the number of lowering steps corresponding to the sheet.

14. An image forming apparatus, comprising:

a sheet feeding device for feeding a sheet; and an apparatus main body including an image forming portion for forming an image on the sheet fed from the sheet feeding device, wherein the sheet feeding device includes:

a sheet accommodating portion for accommodating a sheet stack constituted by a plurality of sheets;

a sheet carrying plate provided in the sheet accommodating portion and carrying the sheet stack;

a pickup roller that contacts an upper face of the sheet stack and dispatches the sheet of an uppermost layer of the sheet stack;

an elevator mechanism that displaces the sheet carrying plate between a sheet feeding position in which the upper face of the sheet stack contacts the pickup roller and a separating position in which the upper face of the sheet stack is separated from the pickup roller;

a first heated air mechanism for blowing heated air toward a side face of the sheet stack accommodated in the sheet accommodating portion, the side face being parallel to the sheet feeding direction; and a controller for controlling the operation of the elevator mechanism and the operation of the first heated air mechanism during a sheet feeding preparation period before starting a sheet feeding operation for feeding a first sheet of the sheet stack, the controller simultaneously performs, during the sheet feeding preparation period, control for operating the first heated air mechanism to blow heated air to the side face of the sheet stack and control for operating the elevator mechanism to cause the elevator mechanism to carry out, at least once, a separating operation for displacing the sheet carrying plate between the sheet feeding position and the separating position.

15. The image forming apparatus according to claim 14, further comprising:

a sheet specifying portion for specifying a type of the sheet to be fed, wherein the controller controls the elevator mechanism to change the degree of lowering the sheet carrying plate in accordance with a type of the sheet specified by the sheet specifying portion.

16. A sheet feeding device for feeding a sheet, comprising:

a sheet accommodating portion for accommodating a sheet stack constituted by a plurality of sheets;

a sheet carrying plate provided in the sheet accommodating portion and carrying the sheet stack;

a pickup roller that contacts an upper face of the sheet stack and dispatches the sheet of an uppermost layer of the sheet stack;

an elevator mechanism that displaces the sheet carrying plate between a sheet feeding position in which the upper face of the sheet stack contacts the pickup roller and a separating position in which the upper face of the sheet stack is separated from the pickup roller;

a first heated air mechanism for blowing heated air toward a side face of the sheet stack accommodated in the sheet accommodating portion, the side face being parallel to the sheet feeding direction;

a second heated air mechanism for blowing heated air toward the upper surface of the sheet stack accommodated in the sheet accommodating portion; and a controller for controlling the operation of the elevator mechanism during the sheet feeding preparation period before a start of a start of a sheet feeding operation of a first sheet of the sheet-like recording media and the operation of the first and second heated air mechanisms, wherein the controller performs, during the sheet feeding preparation period, control for operating the first heated air mechanism to blow heated air to the side face of the sheet stack and control for operating the elevator mechanism to cause the elevator mechanism to carry out, at least once, a separating operation for displacing the sheet carrying plate between the sheet feeding position and the separating position, and wherein the controller controls the second heated air mechanism to blow heated air from the second heated air mechanism to the upper surface of the sheet stack during the sheet feeding preparation period.

17. The sheet feeding device according to claim 16, wherein the controller controls the second heated air mechanism to blow heated air from the second heated air mechanism to the upper surface of the sheet stack during all of the sheet feeding preparation period.

* * * * *